US009096410B2

(12) United States Patent
Iwata

(10) Patent No.: US 9,096,410 B2
(45) Date of Patent: Aug. 4, 2015

(54) MULTI-CAR ELEVATOR CONTROL DEVICE

(75) Inventor: Masafumi Iwata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 603 days.

(21) Appl. No.: 13/520,717

(22) PCT Filed: Dec. 20, 2010

(86) PCT No.: PCT/JP2010/072877

§ 371 (c)(1),
(2), (4) Date: Jul. 5, 2012

(87) PCT Pub. No.: WO2011/108171

PCT Pub. Date: Sep. 9, 2011

(65) Prior Publication Data

US 2012/0279804 A1 Nov. 8, 2012

(30) Foreign Application Priority Data

Mar. 1, 2010 (JP) ..... 2010-043742

(51) Int. Cl.
*B66B 1/34* (2006.01)
*B66B 5/00* (2006.01)
*B66B 5/02* (2006.01)

(52) U.S. Cl.
CPC ..... *B66B 5/0031* (2013.01); *B66B 5/024* (2013.01)

(58) Field of Classification Search
CPC .... B66B 5/0031; B66B 5/024; B66B 1/2433; B66B 1/2466; B66B 5/027
USPC ..... 187/247–249, 313, 316, 317, 380–388, 187/391–393
See application file for complete search history.

(56) References Cited

U.S. PATENT DOCUMENTS 5,663,538 A * 9/1997 Sakita ..... 187/382
5,877,462 A * 3/1999 Chenais ..... 187/249

(Continued)

FOREIGN PATENT DOCUMENTS

CN 1819964 A 8/2006
CN 101139059 A 3/2008

(Continued)

OTHER PUBLICATIONS

International Preliminary Report on Patentability and Written Opinion issued Sep. 13, 2012 in PCTJP2010/072877 filed Dec. 20, 2010 (with English translation).

(Continued)

*Primary Examiner* — Anthony Salata
(74) *Attorney, Agent, or Firm* — Oblon, McClelland, Maier & Neustadt, L.L.P.

(57) ABSTRACT

A multi-car elevator control device for controlling an operation in such a manner that a rear car can stop away from a periphery of a fire floor. The multi-car elevator control device includes a running-enabled section calculator for calculating, as a running-enabled section, a range of a floor in which a stop can be carried out to open a door without a collision with a front car which stops, a fire floor information acquiring part for acquiring fire floor information, an in-fire stop prohibition section calculator for calculating, based on the fire floor information, an in-fire stop prohibition section for prohibiting the stop of the car, and a running permission deciding part for deciding a running permission of an elevator by referring to the running-enabled section and the in-fire stop prohibition section.

8 Claims, 22 Drawing Sheets

(56) References Cited

U.S. PATENT DOCUMENTS

| | | | | |
|---|---|---|---|---|
| 5,979,607 | A * | 11/1999 | Allen | 187/390 |
| 7,178,635 | B2 * | 2/2007 | Meissner et al. | 187/249 |
| 7,182,174 | B2 * | 2/2007 | Parrini et al. | 182/18 |
| 7,594,564 | B2 * | 9/2009 | Siikonen et al. | 187/384 |
| 7,688,212 | B2 * | 3/2010 | Farley | 340/573.1 |
| 7,743,889 | B2 * | 6/2010 | Kawai | 187/313 |
| 7,963,372 | B2 * | 6/2011 | Hikita | 187/387 |
| 8,113,320 | B2 * | 2/2012 | Kawai et al. | 187/384 |
| 8,839,914 | B2 * | 9/2014 | Iwata et al. | 187/384 |
| 2006/0196734 | A1 | 9/2006 | LaBarre et al. | |

FOREIGN PATENT DOCUMENTS

| | | |
|---|---|---|
| EP | 1 371 596 A1 | 12/2003 |
| JP | 6-305648 | 11/1994 |
| JP | 8-133611 | 5/1996 |
| JP | 10-182029 | 7/1998 |
| JP | 2003-81542 | 3/2003 |
| JP | 2004-244123 | 9/2004 |
| JP | 2005-104630 | 4/2005 |
| JP | 2007-137545 | 6/2007 |
| JP | 2008-63017 | 3/2008 |
| WO | WO 2009/054065 A1 | 4/2009 |
| WO | WO 2009/070143 A1 | 6/2009 |

OTHER PUBLICATIONS

International Search Report issued Mar. 22, 2011 in PCT/JP2010/072877.

Office Action issued Sep. 16, 2013 in Korean Patent Application No. 10-2012-7022767 (with English language translation).

Chinese Office Action issued Feb. 28, 2014, in China Patent Application No. 201080064941.1 (with English translation).

Office Action issued Oct. 23, 2013, in German Patent Application No. 11 2010 005 335.9 with English translation.

* cited by examiner

MULTI-CAR ELEVATOR CONTROL DEVICE

TECHNICAL FIELD

The present invention relates to a multi-car elevator control device for controlling an operation in the case of a fire in a multi-car elevator system in which a plurality of cars run along a single hoistway.

BACKGROUND ART

In the case where a fire occurs in a building, an elevator stops a normal operation and carries out an emergency operation, that is, guides a passenger thereof to an evacuation floor. For example, Patent Document 1 describes an elevator control device in a single car elevator system in which only one car runs in a single hoistway. In the elevator control device, fire detecting means such as a fire sensor is provided on each floor in a building and stop floor selecting means collates a signal output from the fire detecting means with a signal output from priority stop floor storing means storing a priority stop floor which is previously ranked, and automatically selects the evacuation floor of the elevator, thereby controlling an elevator control panel. According to the present invention, an emergency operation which avoids a stop on a floor in which the fire occurs is automatically carried out. Thus, a smooth and safe evacuation of a passenger thereof is ensured.

In the case of a multi-car elevator system in which a plurality of cars run along a single hoistway, however, it is necessary to control an operation in such a manner that cars do not collide with each other as described in Patent Document 3, and the elevator control device in Patent Document 1 cannot be applied to the multi-car elevator system.

As an example of a fire emergency operation in the multi-car elevator system, in the case where the emergency operation in an occurrence of a disaster is carried out in the apparatus for operating an elevator described in Patent Document 2, an emergency operation for a lower car is completed and the lower car is then caused to move from an evacuation floor to a lower floor, and an emergency operation for an upper car is subsequently carried out. Consequently, it is possible to carry out a rapid emergency operation in an earthquake emergency operation and a fire emergency operation.

PRIOR ART DOCUMENT

Patent Document

Patent Document 1: Japanese Patent Application Laid-Open No. H10-182029 (1998)

Patent Document 2: Japanese Patent Application Laid-Open No. 2004-244123

Patent Document 3: Japanese Patent Application Laid-Open No. 2003-081542

SUMMARY OF THE INVENTION

Problems to be Solved by the Invention

In the apparatus for operating an elevator described in the Patent Document 2, when a car running in a forward part (a front car) passes through the vicinity of a floor where a fire has occurred, a rear car is not controlled. In a fire emergency operation or a fire evacuation operation of a multi-car system, therefore, in the case where the front car stops for some reason on slightly lower floor from the fire floor, there is a possibility that the rear car should stop on the fire floor or a floor placed just above the fire. In this case, a passenger in the rear car is put in a dangerous situation due to the stop of the front car.

In consideration of the above-described problems, it is an object of the present invention to provide a multi-car elevator control device for controlling an operation so as to enable a rear car to stop away from a periphery of a fire floor in the case where a front car stops for some reason in a multi-car elevator system.

Means for Solving the Problem

A first multi-car elevator control device according to the present invention is a multi-car elevator control device for controlling an operation of each of cars in a multi-car elevator system in which the plurality of cars run along a single hoistway, including a running-enabled section calculator for calculating, as a running-enabled section, a range of a floor in which a stop can be carried out to open a door without a collision with a front car which stops, a fire floor information acquiring part for acquiring fire floor information, an in-fire stop prohibition section calculator for calculating an in-fire stop prohibition section for prohibiting a stop of the car based on the fire floor information, and a running permission deciding part for deciding a running permission of an elevator by referring to the running-enabled section and the in-fire stop prohibition section.

Moreover, a second multi-car elevator control device according to the present invention is a multi-car elevator control device for controlling an operation of each of cars in a multi-car elevator system in which the plurality of cars run along a single hoistway, including a fire floor information acquiring part for acquiring fire floor information, an in-fire blocking section setting part for setting an in-fire blocking section permitting only one car to run based on the fire floor information, and an in-fire blocking controller for controlling other cars so as not to enter an in-fire blocking section when a single car is present in the in-fire blocking section.

Effect of the Invention

The first multi-car elevator control device according to the present invention is a multi-car elevator control device for controlling an operation of each of cars in a multi-car elevator system in which the plurality of cars run along a single hoistway, including a running-enabled section calculator for calculating, as a running-enabled section, a range of a floor in which a stop can be carried out to open a door without a collision with a front car which stops, a fire floor information acquiring part for acquiring fire floor information, an in-fire stop prohibition section calculator for calculating an in-fire stop prohibition section for prohibiting a stop of the car based on the fire floor information, and a running permission deciding part for deciding a running permission of an elevator by referring to the running-enabled section and the in-fire stop prohibition section. By controlling the car in such a manner that a floor other than the in-fire stop prohibition section is always included in the stop enabling range, even in the case where the front car stops on a floor in the vicinity of a fire floor for some reason, a rear car stops in a place other than the in-fire stop prohibition section to enable a passenger to escape from the car to an outside.

Moreover, the second multi-car elevator control device according to the present invention is a multi-car elevator control device for controlling an operation of each of cars in a multi-car elevator system in which the plurality of cars run along a single hoistway, including a fire floor information acquiring part for acquiring fire floor information, an in-fire blocking section setting part for setting an in-fire blocking section permitting only one car to run based on the fire floor information, and an in-fire blocking controller for controlling other cars so as not to enter the in-fire blocking section when a single car is present in the in-fire blocking section. By carrying out the control in such a manner that only one car is present in the in-fire blocking section placed within a predetermined range from the fire floor, even in the case where the front car stops on a floor in the vicinity of the fire floor for some reason, the rear car stops in a place other than the in-fire stop prohibition section, thereby enabling a passenger to escape from the car to an outside.

These and other objects, features, aspects, and advantages of the present invention will become more apparent from the following detailed description of the present invention when taken in conjunction with the accompanying drawings.

EMBODIMENT FOR CARRYING OUT THE INVENTION (First Embodiment)

<Underlying Technique>

In a multi-car elevator system in which a plurality of cars run along a single hoistway, a multi-car elevator control device avoids a mutual collision between cars in the same shaft and controls a collision avoiding operation control in such a manner that the car does not stop between floors as described in Japanese Patent Application Laid-Open No. 2003-81542.

Figure 1:
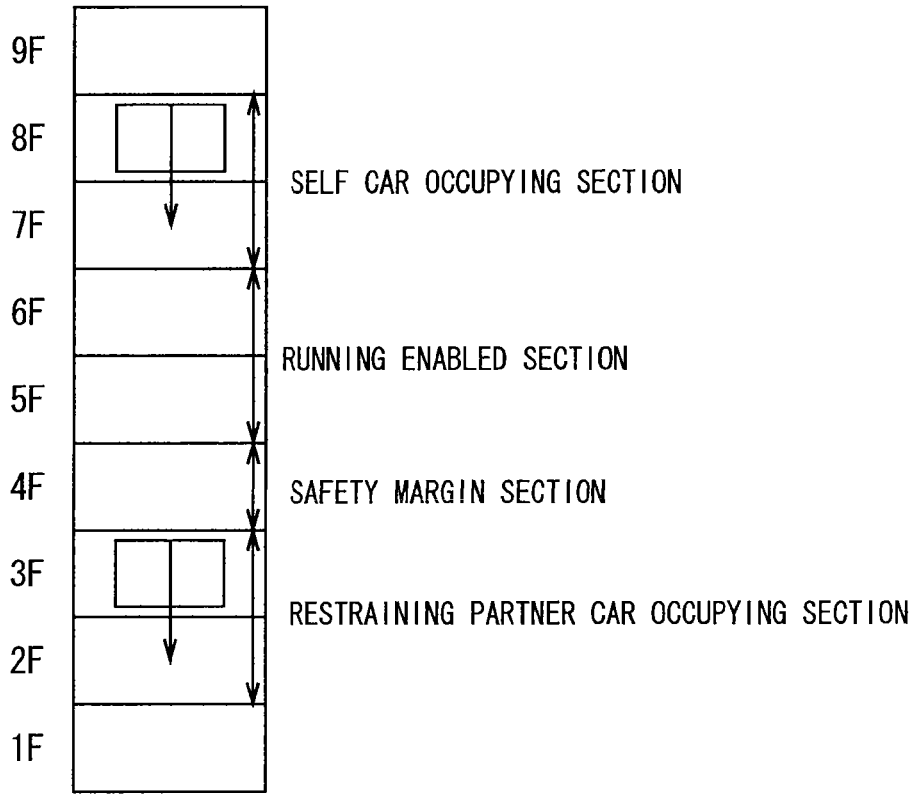
FIG. 1 is a conceptual view showing a collision avoiding operation control in a multi-car system.

FIG. 1 shows a concept of the collision avoiding operation control. In the drawing, there is shown a control method of setting a car running in 8F as a self car and controlling the self car. A car with which the self car might collide, more specifically, a last car is set to be a restraining partner car. A section from a current position of the self car to a close floor where the car can stop is set to be a self car occupying section (herein, 8F to 7F). Next, a section from a current position of the restraining partner car to a close floor in which the car can stop is set to be a restraining partner car occupying section (herein, 3F to 2F). Moreover, a section from an adjacent floor (herein, 4F) in a direction in which the self car in the restraining partner car occupying section is present to a position on this side of a predetermined safety margin distance (herein, a 1F portion) is determined as a safety margin section (herein, 4F). A section from an adjacent floor (herein, 5F) in a direction in which the self car in the safety margin section is present to a previous floor (herein, 6F) in the self car occupying section is set to be a running-enabled section, and the self car can be permitted to run as long as the self car occupying section in the case of a continuous run is a current running-enabled section. In the case where the self car occupying section overlaps with the safety margin section, the stop of the self car is determined.

Next, a method of controlling, in a fire, a car of the multi-car elevator control device will be described. A mode in which an elevator runs in the fire includes a fire emergency operation, an evacuation operation and a fire fighting operation. In the fire emergency operation, a passenger which has already got on in an occurrence of the fire is escaped to an evacuation floor and the car is then caused to stop in the evacuation floor. The evacuation operation is carried out such that the passenger is continuously rescued from an upper floor to the evacuation floor. The fire fighting operation is carried out by a manipulation of a fireman or the like, and the elevator is utilized for a fire fighting work or a rescue work. In general, a fire floor or a floor placed just above the fire is set to be a dangerous floor, and it is necessary to avoid at least a careless stop of the car on the fire floor or on the floor placed just above the fire as much as possible.

In the multi-car elevator system using the collision avoiding operation control, however, in some cases where the restraining partner car stops on a floor placed just below the fire floor, for example, the self car is to stop on a fire floor, on a floor placed just above the fire or on a floor in the vicinity thereof in order to avoid a collision with the restraining partner car, resulting in a dangerous situation. In the multi-car elevator control device according to the present embodiment, therefore, a section on the periphery of the fire floor in which a stop is not desirable is defined as an in-fire stop prohibition section, and it is assumed that a control for stopping the car is carried out in the case where there is a possibility that the stop can be carried out in only the in-fire stop prohibition section when the running operation is continuously performed.

<Structure>

Figure 3:
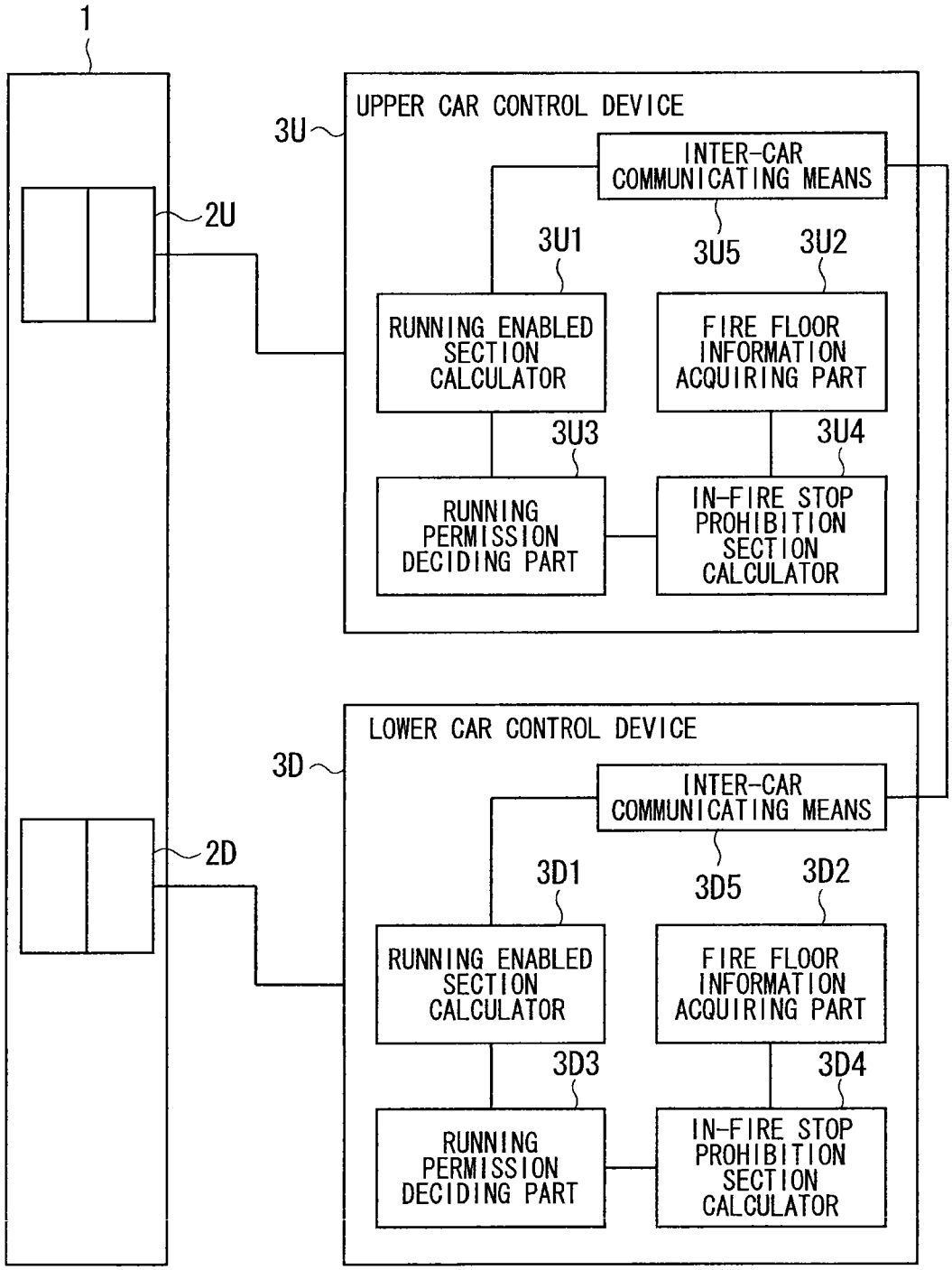
FIG. 3 is a diagram showing a structure of the multi-car elevator control device according to the first embodiment.

FIG. 3 shows a structure of the multi-car elevator control device. It is assumed that an upper car 2U and a lower car 2D run along a hoistway 1. The multi-car elevator control device is shown as an upper car control device 3U for controlling an operation of the upper car 2U and a lower car control device 3D for controlling an operation of the lower car 2D in the drawing. The upper car control device 3U includes inter-car communicating means 3U5 for performing communication with the lower car control device 3D to acquire position information about the lower car 2D, a running-enabled section calculator 3U1 for calculating a running-enabled section, a fire floor information acquiring part 3U2 for acquiring information about a fire floor, a running permission deciding part 3U3 for deciding a running permission, and an in-fire stop prohibition section calculator 3U4 for calculating an in-fire stop prohibition section. The lower car control device 3D also includes a running-enabled section calculator 3D1, a fire floor information acquiring part 3D2, a running permission deciding part 3D3 and an in-fire stop prohibition section calculator 3D4 in addition to inter-car communicating means 3D5 for performing communication with the inter-car communicating means 3U5 of the upper car control device 3U.

For the upper car control device 3U, the upper car 2U is a self car and the lower car 2D is a restraining partner car. The fire floor information acquiring part 3U2 obtains information about a floor in which a fire has occurred (fire floor information) through a fire preventing device such as a fire sensor, a heat sensor or a fire alarm which is provided in a building where an elevator is installed. The in-fire stop prohibition section calculator 3U4 calculates the in-fire stop prohibition section based on the fire floor information obtained by the fire floor information acquiring part 3U2 and individual distances in upward and downward directions from the fire floor which is previously determined on the basis of an operation, a fire resistance performance of a building or the like. Here, the in-fire stop prohibition section represents a section in which the stop of the car is prohibited in the fire. The running-enabled section calculator 3U1 acquires an occupying section of the lower car (the restraining partner car) 2D through the inter-car communicating means 3U5 and calculates a running-enabled section based on the occupying section and a self-car occupying section. The running permission deciding part 3U3 acquires a running-enabled section and an in-fire stop prohibition section from the running-enabled section calculator 3U1 and the in-fire stop prohibition section calculator 3U4, respectively, and decides the running permission of the upper car (the self car) 2U based on them.

Also in the lower car control device 3D, the running permission of the lower car 2D is decided by the same operation as that of the upper car control device 3U.

<Operation>

Figure 2:
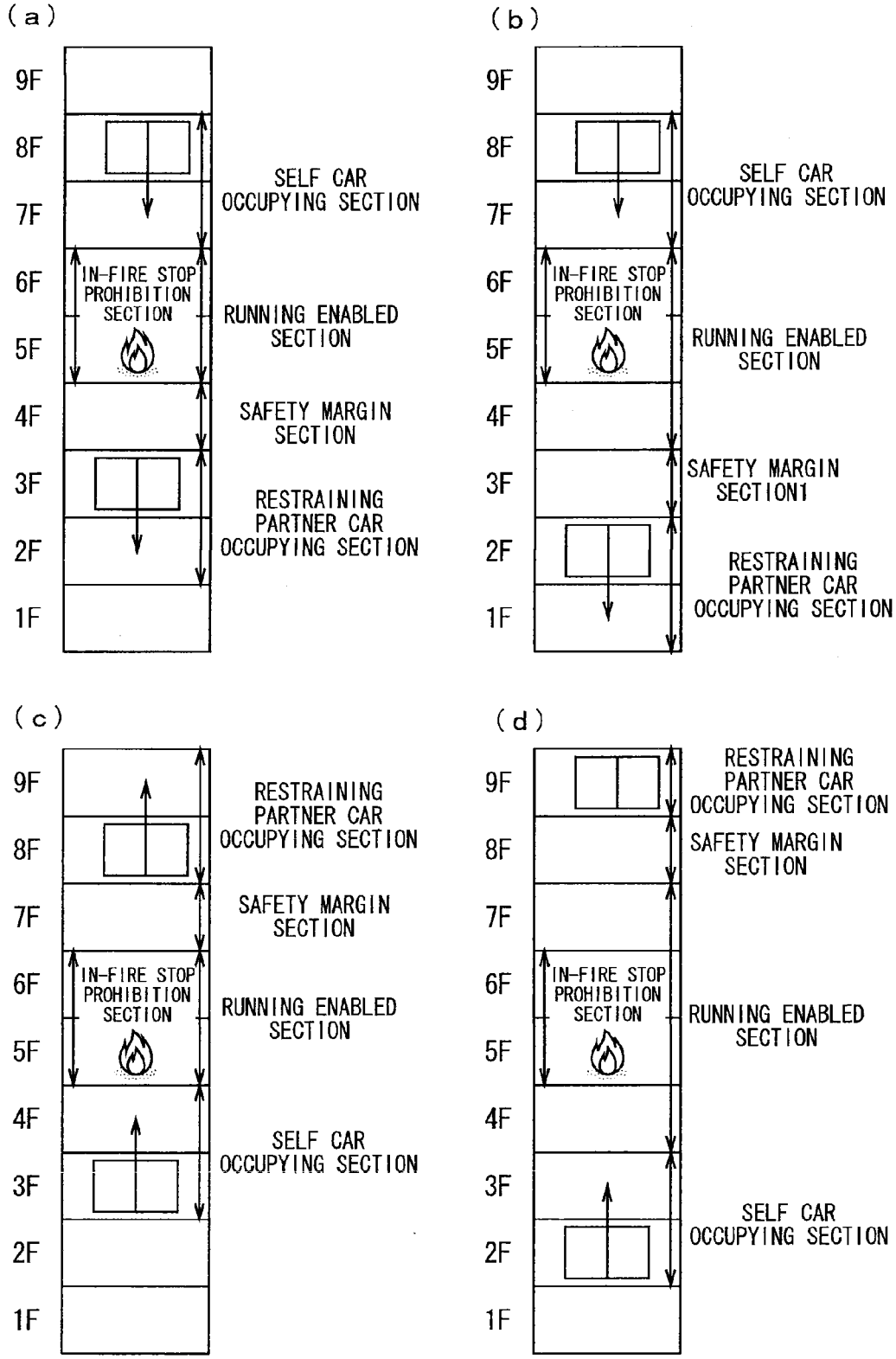
FIG. 2 is a conceptual view showing an operation control in a fire in a multi-car elevator control device according to a first embodiment.

With reference to FIG. 2, description will be given to an operation of the multi-car elevator control device according to the present embodiment. Here, a fire occurs on 5F, and 5F and 6F of a fire floor and a floor placed just above the fire are set to be an in-fire stop prohibition section. Part (a) of FIG. 2 shows a situation in which the self car is running from 8F to 7F and the restraining partner car is running from 3F to 2F. In this case, the self car occupying section has 8F and 7F, the restraining partner car occupying section has 3F and 2F, and the safety margin section has 4F. Accordingly, the running-enabled section has 5F to 6F. There is no floor which does not serve as the in-fire stop prohibition section in the running-enabled section. For this reason, a stop command is given to the self car so that the self car stops on 7F. Even if the restraining partner car stops on 3F for some reason, consequently, it is possible for the self car to avoid the stop in the in-fire stop prohibition section.

Part (b) of FIG. 2 shows a situation in which the self car is running from 8F to 7F and the restraining partner car is running from 2F to 1F. In this case, the self car occupying section has 8F and 7F, the restraining partner car occupying section has 2F and 1F, the safety margin section has 3F, and the running-enabled section has 4F to 6F. Accordingly, the floor which does not serve as the in-fire stop prohibition section has 4F. In this case, if the restraining partner car stops emergently on 2F, the self car can stop on 4F by setting the safety margin section of 3F to be empty and collides with the restraining partner car nor is influenced by the fire. Therefore, the self car can continuously run, thereby passing through 7F, Part (c) of FIG. 2 shows a situation in which the self car is neither running from 3F to 4F and the restraining partner car is running from 8F to 9F. In this case, the self car occupying section has 3F and 4F, the restraining partner car occupying section has 8F and 9F, the safety margin section has 7F, and the running-enabled section has 5F and 6F. There is no floor which does not serve as the in-fire stop prohibition section in the running-enabled section. For this reason, a stop command is given to the self car so that the self car stops on 4F. Even if the restraining partner car stops on 8F for some reason, consequently, it is possible to avoid the stop in the in-fire stop prohibition section.

Part (d) of FIG. 2 shows a situation in which the self car is running from 2F to 3F and the restraining partner car remains at rest on 9F. In this case, the self car occupying section has 2F and 3F, the restraining partner car occupying section has 9F, the safety margin section has 8F, and the running-enabled section has 4F to 7F. 4F and 7F are present for the floor which does not serve as the in-fire stop prohibition section. Accordingly, the self car can stop on 4F or 7F by setting the safety margin section of 8F to be empty and neither collides with the restraining partner car nor is influenced by the fire. Therefore, the self car can continuously run, thereby passing through 3F, As described above, the multi-car elevator control device according to the present embodiment includes the running-enabled section calculator 3U1 for calculating, as a running-enabled section, a range of a floor in which a stop can be carried out to open a door without a collision with a front car which stops, the fire floor information acquiring part 3U2 for acquiring fire floor information, the in-fire stop prohibition section calculator 3U4 for calculating a floor within a predetermined range including a fire floor as an in-fire stop prohibition section for prohibiting a stop of a car based on the fire floor information, and the running permission deciding part 3U3 for deciding a running permission of an elevator by referring to the running-enabled section and the in-fire stop prohibition section. By controlling the car in such a manner that a section other than the in-fire stop prohibition section is always included in the stop enabling range, even in the case where the front car stops for some reason, the rear car can stop in a place other than the in-fire stop prohibition section, thereby causing a passenger to escape from the car to an outside.

Moreover, the in-fire stop prohibition section calculator 3U4 sets, as the in-fire stop prohibition section, a range obtained by adding a predetermined distance in upward and downward directions from a position of the fire floor included in the fire floor information. By controlling the car in such a manner that the stop enabling range always includes a place other than the in-fire stop prohibition section thus determined, even in the case where the front car stops for some reason, the rear car can stop in a place other than the in-fire stop prohibition section, thereby causing the passenger to escape from the rear car to the outside.

Figure 4:
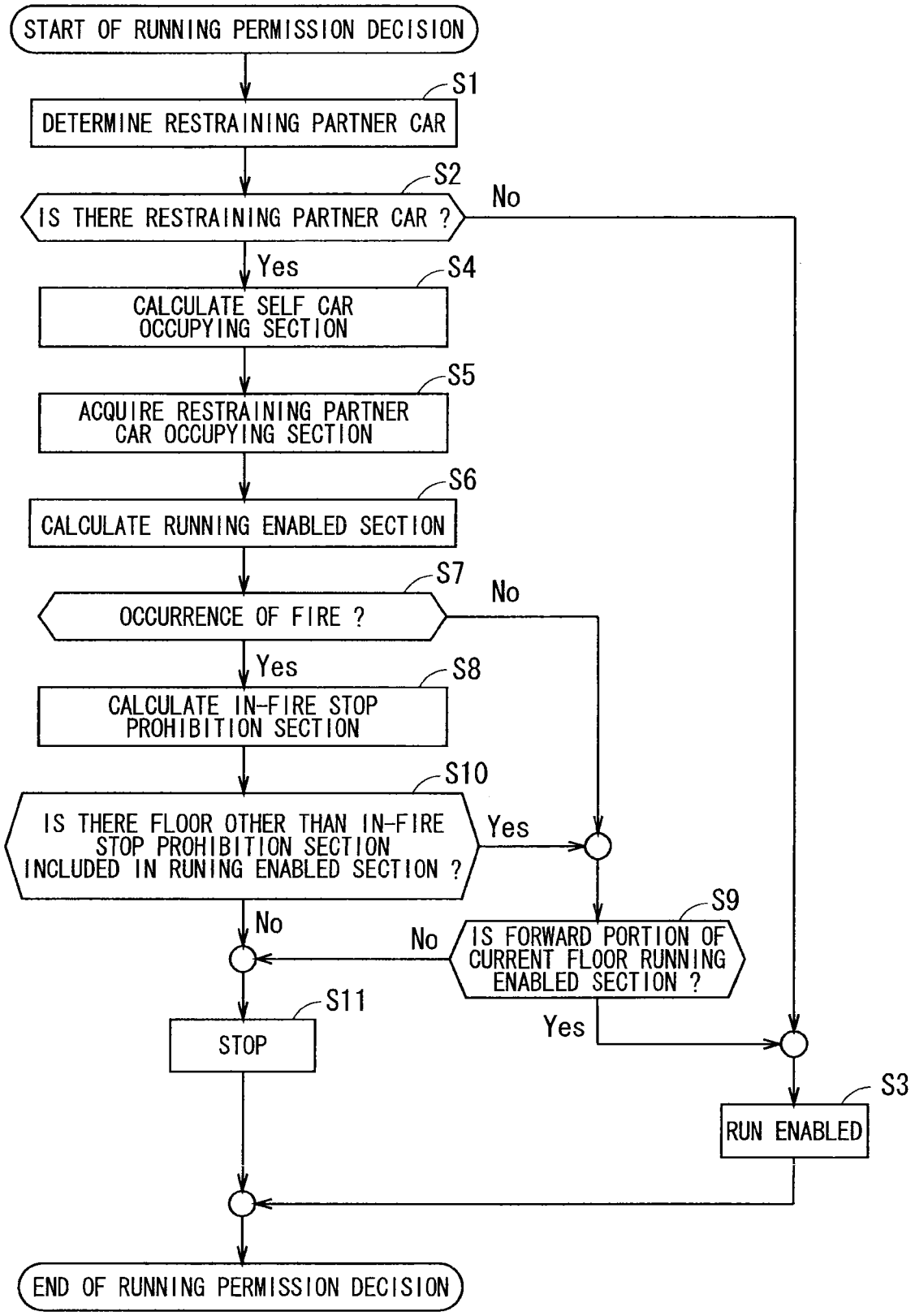
FIG. 4 is a flow chart showing an operation of the multi-car elevator control device according to the first embodiment.

FIG. 4 is a flow chart deciding a running permission of the multi-car elevator control device described above. First of all, a car placed in the closest position in a forward portion in a running direction of the self car is determined as a restraining partner car in the running-enabled section calculator 3U1 (Step S1). If the car is not present in the forward portion, it is determined that there is no restraining partner car. Next, the running-enabled section calculator 3U1 decides whether the restraining partner car is present or not (Step S2). If the restraining partner car is not present, the running permission deciding part 3U3 decides that the running operation can be continuously carried out (Step S3) and the processing is ended.

If the restraining partner car is present in Step S2, the running-enabled section calculator 3U1 calculates a self car occupying section (Step S4). Here, the self car occupying section represents a section from a current position of the self car to a forward close floor from a stop enabling position. Furthermore, the running-enabled section calculator 3U1 acquires the restraining partner car occupying section from the control device of the restraining partner car through the car communicating means 3U5 (Step S5). Herein, the restraining partner car occupying section represents a section from a current position of the restraining partner car to a forward close floor from a stop enabling position and is calculated by the restraining partner car control device. Thereafter, the running-enabled section calculator 3U1 calculates a running-enabled section from the self car occupying section and the restraining partner car occupying section (Step S6).

Next, the in-fire stop prohibition section calculator 3U4 decides whether a fire occurs or not based on the fire floor information acquired in the fire floor information acquiring part 3U2 (Step S7). If the fire occurs, an in-fire stop prohibition section is calculated (Step S8). Here, the in-fire stop prohibition section is determined based on individual distances in upward and downward directions from a fire floor which is predefined on the basis of an operation, a fire resistance performance of a building or the like, and the fire floor information. For example, when the fire floor is represented by F, a distance in an upward direction is represented by $\alpha$ and a distance in a downward direction is represented by $\beta$, the in-fire stop prohibition section is a section from an $F-\beta$ floor to an $F+\alpha$ floor.

Subsequently, the running permission deciding part 3U3 decides whether a floor other than the in-fire stop prohibition section is included in the running-enabled section or not (Step S10). If the floor is not included, the car is caused to stop at step S11 and the processing is ended.

If the fire does not occur (No in Step S7) or the floor other than the in-fire stop prohibition section is present in the running-enabled section in Step S10, it is decided whether a forward portion of a current floor is the running-enabled section or not (Step S9). If the forward portion is the running-enabled section, it is decided that a running operation can be carried out (Step S3) and the processing is ended. If the forward portion is not the running-enabled section, the car stops (Step S11) and the processing is ended.

Although the description has been given to the operation of the upper car control device 3U for deciding the running permission of the upper car 2U, the lower car control device 3D also decides the running permission of the lower car 2D by the same operation. By constituting the upper and lower car control devices as described above, it is possible to avoid a situation in which the self car is to stop in the in-fire stop prohibition section in the vicinity of the fire floor due to the stop of the restraining partner car in the fire. Furthermore, it is not necessary to provide a distance between the cars beyond a distance required for a safety. Therefore, an operation can be carried out efficiently.

Figure 5:
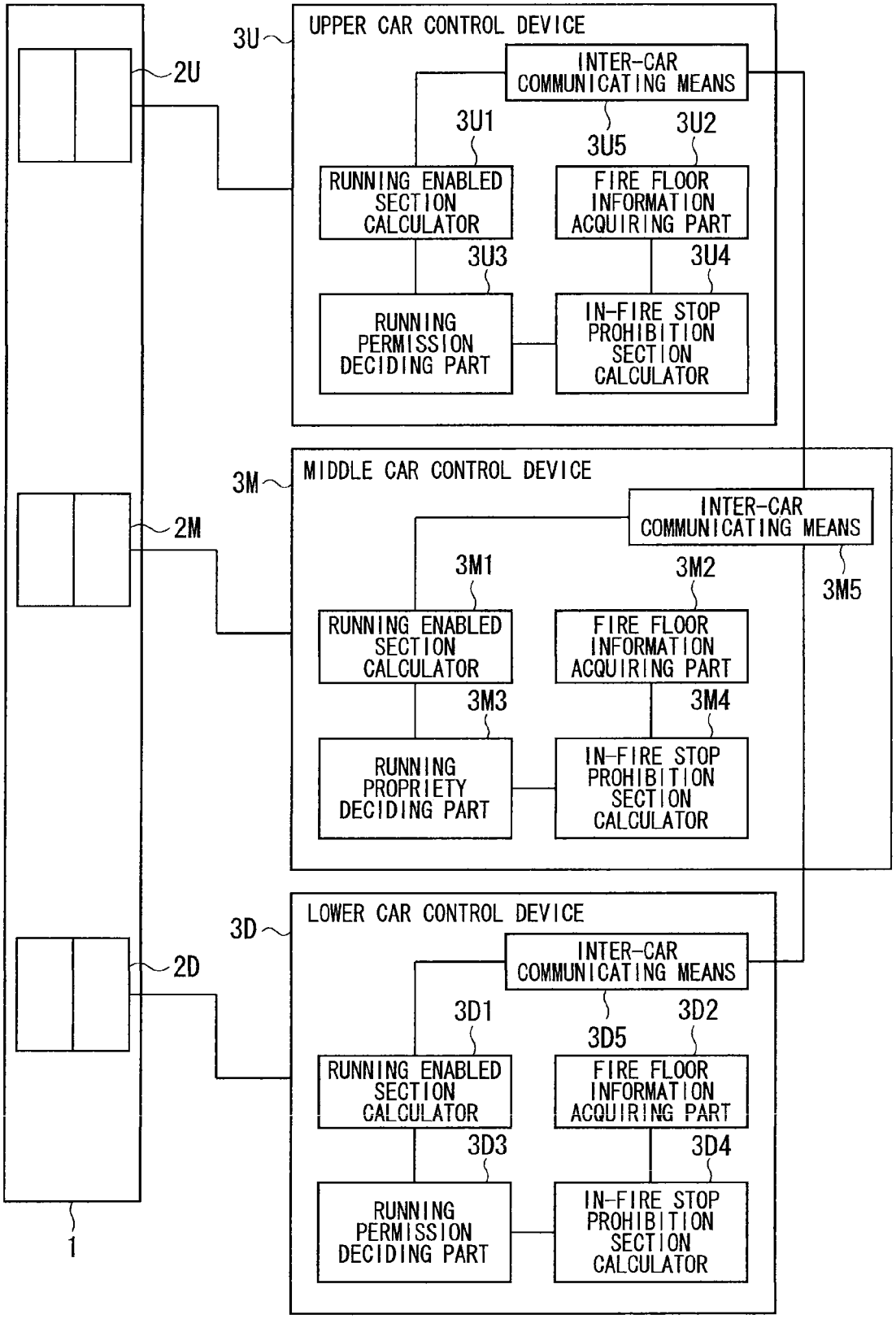
FIG. 5 is a diagram showing the structure of the multi-car elevator control device according to the first embodiment.

Although the operation of the multi-car elevator control device has been described on the assumption that two cars run along a single hoistway, the number of the cars running along the single hoistway is not restricted thereto. In the case where three cars are present, for example, it is preferable to provide the car control device having the structure described above in each of an upper car 2U, a middle car 2M and a lower car 2D as shown in FIG. 5. The case in which the number of the cars is four or more is also the same.

Figure 6:
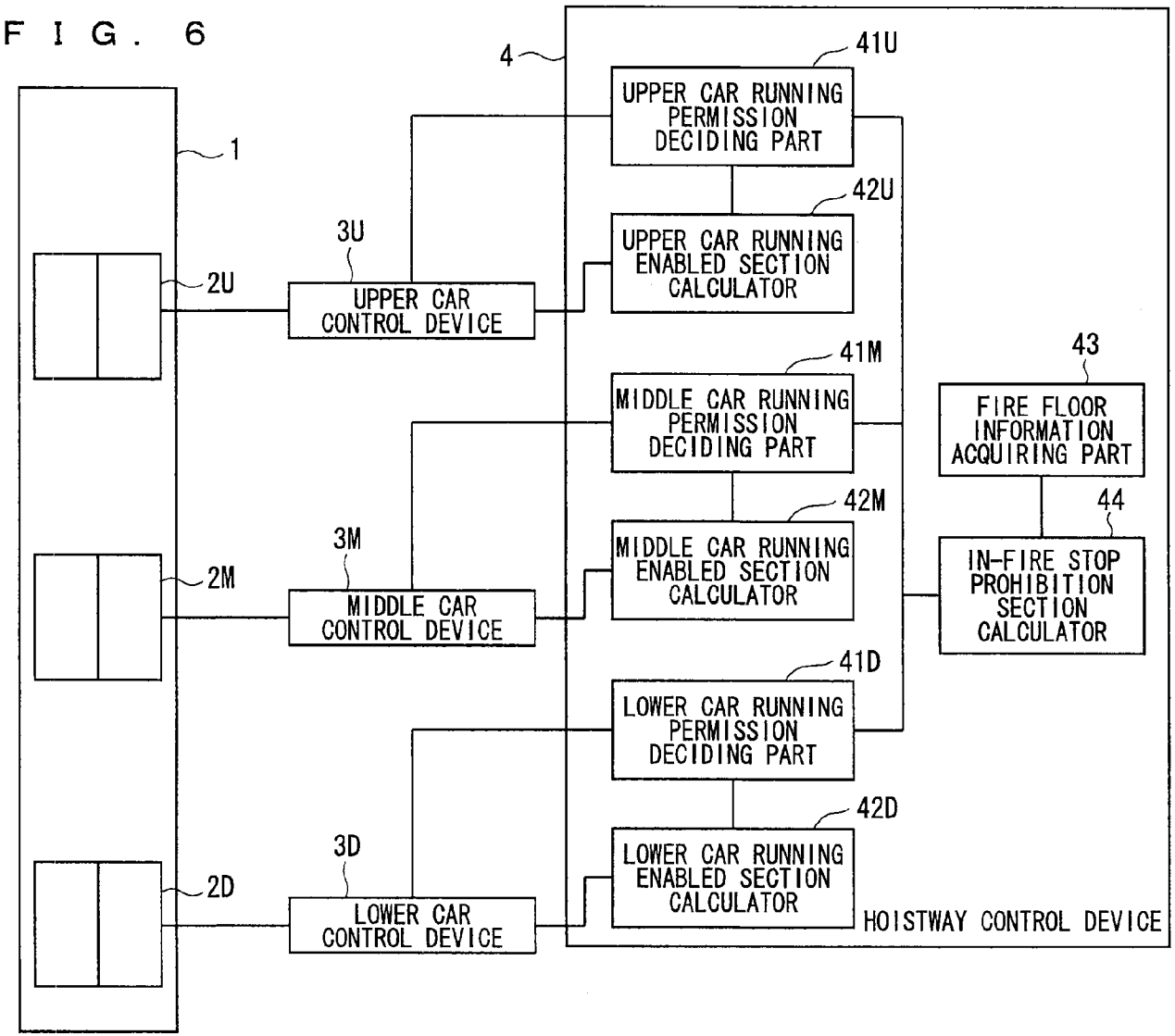
FIG. 6 is a diagram showing the structure of the multi-car elevator control device according to the first embodiment.

Moreover, the running permission deciding part, the running-enabled section calculator, the fire floor information acquiring part and the in-fire stop prohibition section calculator are not set to be components of the car control Device provided for each of the cars but may be components of the hoistway Control device 4 provided for each of the hoistways as shown in FIG. 6. by Setting them as the components of the hoistway control device 4, the numbers Of the fire floor information aquiring parts 43 and the in-fire stop prohibition Section calculators 44 which are to be provided do not need to correspond to The number of cars but may be one, and the inter-car communicating means for performing communication between the car control devices is not required.

<Effect>

The following effects can be obtained in the multi-car elevator control device according to the present embodiment as described above. In other words, the multi-car elevator control device according to the present embodiment serves to control the operation of each car in the multi-car elevator system in which a plurality of cars run along a single hoistway, and is characterized to include the running-enabled section calculator 3U1 for calculating, as a running-enabled section, a range of a floor in which a stop can be carried out to open a door without a collision with a front car which stops, the fire floor information acquiring part 3U2 for acquiring fire floor information, the in-fire stop prohibition section calculator 3U4 for calculating a floor within a predetermined range including a fire floor as an in-fire stop prohibition section for prohibiting a stop of a car based on the fire floor information, and the running permission deciding part 3U3 for deciding a running permission of an elevator by referring to the running-enabled section and the in-fire stop prohibition section. By controlling the car in such a manner that a section other than the in-fire stop prohibition section is always included in the stop enabling range, the rear car can stop in a place other than the in-fire stop prohibition section, thereby causing a passenger to escape from the rear car to an outside also in the case where the front car stops for some reason.

Moreover, the in-fire stop prohibition section calculator 3U4 sets, as the in-fire stop prohibition section, a range obtained by adding a predetermined distance in upward and downward directions from a position of the fire floor included in the fire floor information. By controlling the car in such a manner that the stop enabling range always includes a place other than the in-fire stop prohibition section thus determined, even in the case where the front car stops for some reason, the rear car can stop in a place other than the in-fire stop prohibition section, thereby causing the passenger to escape from the rear car to the outside.

(Second Embodiment)

<Structure>

Figure 9:
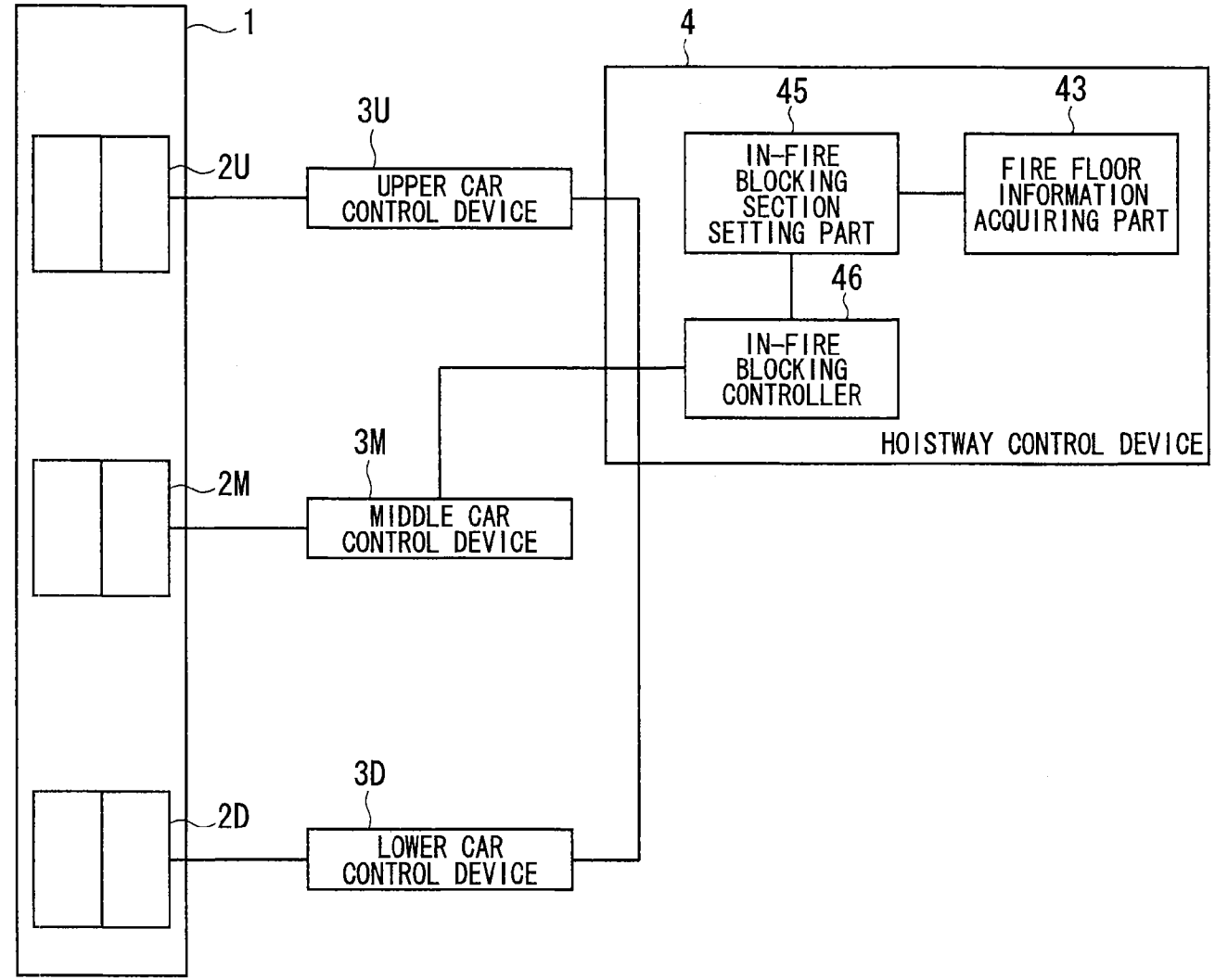
FIG. 9 is a diagram showing a structure of the multi-car elevator control device according to the second embodiment.

FIG. 9 shows a structure of a multi-car elevator control device according to a second embodiment. The drawing shows a multi-car elevator system in which an upper car 2U, a middle car 2M and a lower car 2D run along a single hoistway 1. The upper car 2U is provided with an upper car control device 3U for controlling an operation of the upper car 2U, the middle car 2M is provided with a middle car control device 3M for controlling an operation of the middle car 2M, and the lower car 2D is provided with a lower car control device 3D for controlling an operation of the lower car 2D. The number of the cars in the single hoistway is not restricted to be three but an application can be carried out for an optional number of two or more.

A hoistway control device 4 provided in the hoistway 1 decides a running permission of each of the cars 2U, 2M and 2D and transmits the running permission to the car control devices 3U, 3M and 3D. The hoistway control device 4 includes a fire floor information acquiring part 43, an in-fire blocking section setting part 45 and an in-fire blocking controller 46.

Since the fire floor information acquiring part 43 is the same as that described in the first embodiment, explanation will be omitted. The in-fire blocking section setting part 45 sets an in-fire blocking section based on fire floor information obtained from the fire floor information acquiring part 43. The in-fire blocking section represents a section in which only one car is allowed to run in the case of a fire. The in-fire blocking controller 46 controls the car in the hoistway 1 in such a manner that only one car runs to the in-fire blocking section. Actually, a result of the decision of the running permission is transmitted to each of the car control devices 3U, 3M and 3D.

<Operation>

Figure 7:
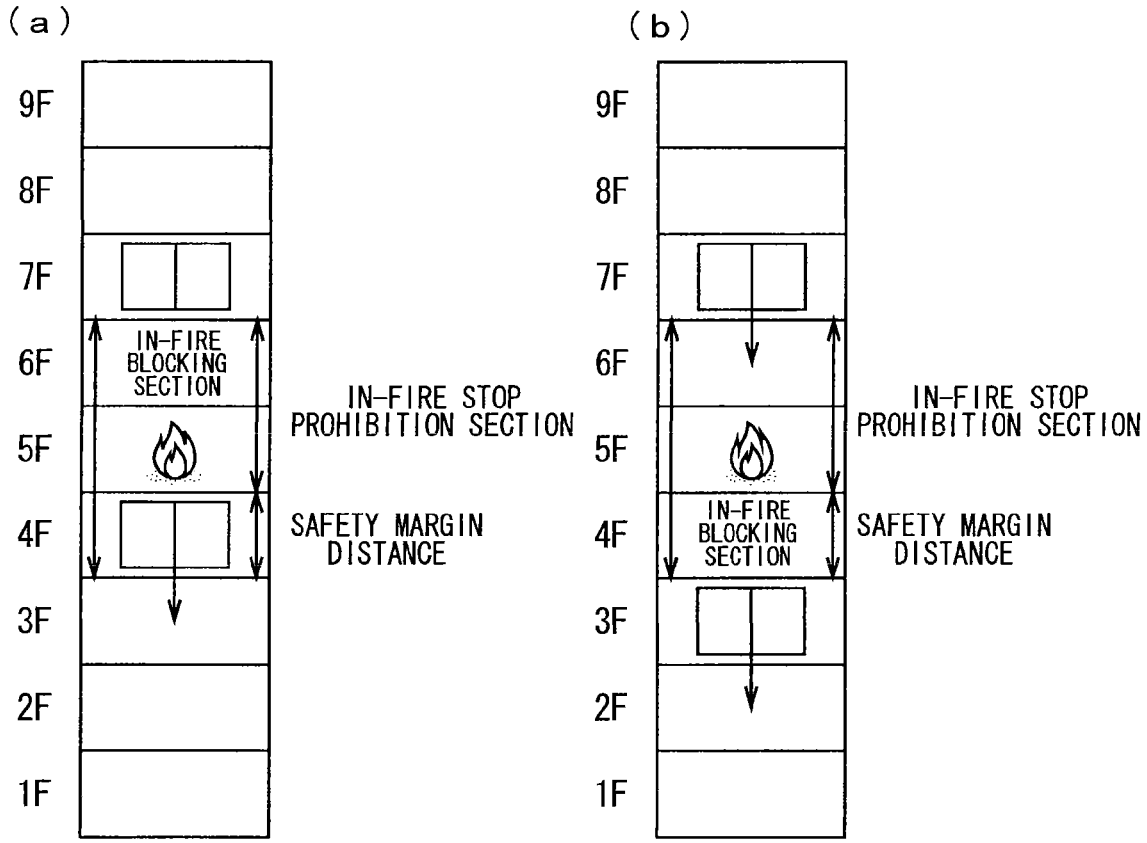
FIG. 7 is a conceptual view showing an operation control in a fire in a multi-car elevator control device according to a second embodiment.
Figure 8:
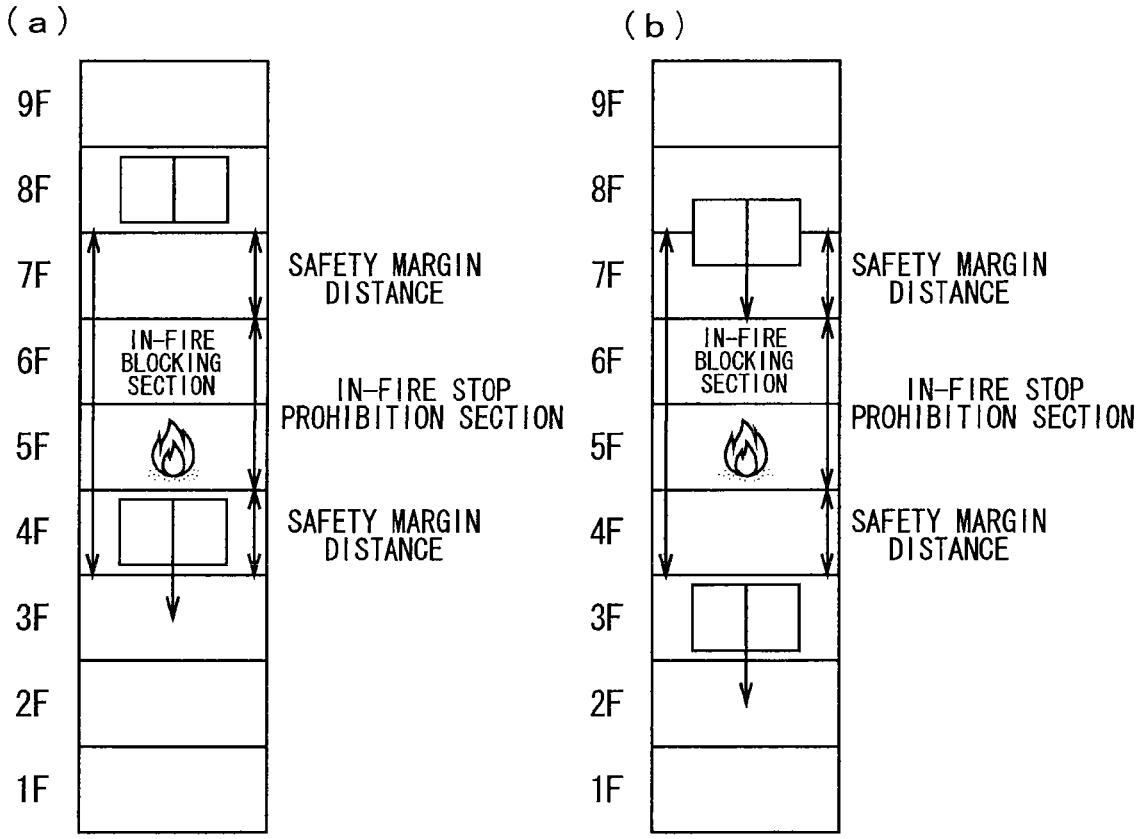
FIG. 8 is a conceptual view showing the operation control in the fire in the multi-car elevator control device according to the second embodiment.

Referring to FIGS. 7 and 8, description will be given to an operation of a multi-car elevator according to the present embodiment. FIG. 7 shows the case where, as for the in-fire stop prohibition section described in the first embodiment, a section obtained by adding a safety margin distance to a running direction side of the car is set as the in-fire blocking section, and a control is carried out in such a manner that only one car is allowed to run in the in-fire blocking section. When a fire does not occur, a collision avoiding control is carried out in the same manner as in the first embodiment.

Part (a) of FIG. 7 shows a situation in which a self car is present in 7F and a front car is running from 4F to 3F. A fire floor is 5F, and 5F and 6F to be the fire floor and a floor placed just above a fire are set to be in-fire stop prohibition sections. If a safety margin distance is determined as a IF portion, the in-fire stop blocking section is set to be 4F to 6F obtained by extending the in-fire stop prohibition section by the safety margin distance portion in a downward direction. In this case, the front car has already run in the in-fire blocking section. For this reason, the self car cannot advance to 6F being the in-fire blocking section and is controlled to stop in 7F.

In part (b) of FIG. 7, a fire occurs on 5F in the same manner as in part (a) of FIG. 7 and the fire stop prohibition section is set to be 5F and 6F and the in-fire blocking section is set to be 4F to 6F. The self car is present on 7F and the front car is running from 3F to 2F. In this case, no car runs in the in-fire blocking section. Therefore, the self car can advance to 6F.

In the case where all of the cars run in only a direction of an evacuation floor as in a fire emergency operation, it is preferable to add the safety margin distance to only one end side (the direction of the evacuation floor) of the in-fire stop prohibition section, thereby setting the in-fire blocking section as shown in FIG. 7. In the case where the car reciprocates as in an evacuation operation or a fire fighting operation, however, it is necessary to add the safety margin distance to both ends of the in-fire stop prohibition section, thereby setting the in-fire blocking section as shown in FIG. 8.

In FIG. 8, a fire floor is 5F, and 5F and 6F being the fire floor and a floor placed just above the fire are set to be the in-fire stop prohibition sections. If the safety margin distance is determined to be a 1F portion, the in-fire blocking section is set to be 4F to 7F obtained by extending the in-fire stop prohibition section by the safety margin distance in both upper and lower directions. Part (a) of FIG. 8 shows a situation in which the self car is present on 8F and the front car is running from 4F to 3F. The front car is running in the in-fire blocking section. Therefore, the self car cannot advance to 7F which is the in-fire blocking section but is controlled to stop in 8F. Part (b) of FIG. 8 shows a situation in which the self car is present on 8F and the front car is running from 3F to 2F. In this case, no car is running in the in-fire blocking section. Therefore, the self car can proceed to 7F.

As described above, the multi-car elevator control device according to the present embodiment serves to control an operation of each car in a multi-car elevator system in which a plurality of cars run along a single hoistway, and includes a fire floor information acquiring part 43 for acquiring fire floor information, an in-fire blocking section setting part 45 for setting an in-fire blocking section which permits only one car to run based on the fire floor information, and an in-fire blocking controller 46 for controlling other cars so as not to enter the in-fire blocking section when a single car is present in the in-fire blocking section. By controlling the car in such a manner that only one car is present in the in-fire blocking section provided within a predetermined range from a fire floor, even in the case where a front car stops on a floor placed in the vicinity of the fire floor for some reason, it is possible to cause a rear car to stop in a place other than the in-fire stop prohibition section, thereby escaping a passenger to an outside of the car.

Figure 10:
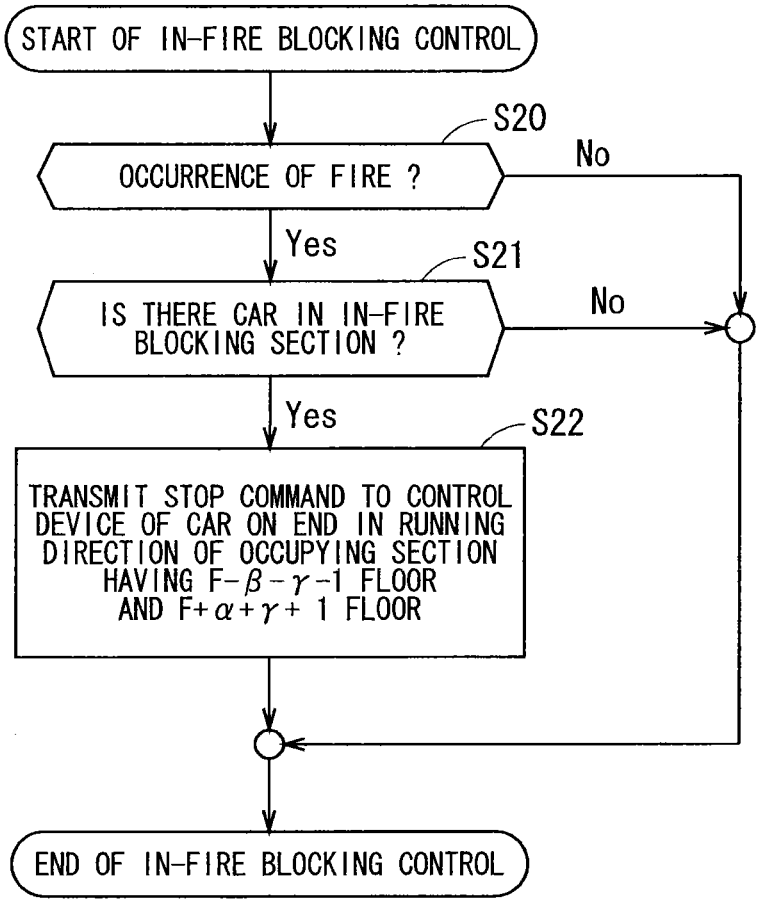
FIG. 10 is a flow chart showing an operation of the multi-car elevator control device according to the second embodiment.

FIG. 10 is a flow chart showing an in-fire blocking control to be carried out by the in-fire blocking controller 46. The in-fire blocking controller 46 decides whether a fire occurs or not based on the fire floor information acquired by the fire floor information acquiring part 43 (Step S20). If the fire does not occur, the in-fire blocking control is ended to carry out a normal collision avoiding operation control. If the fire occurs, it is decided whether a car is present in the in-fire blocking section or not (Step S21).

Here, the in-fire blocking section is set in the following manner on the basis of the fire floor information obtained from the fire floor information acquiring part 43 by the in-fire blocking section setting part 45. First of all, a fire floor stop prohibition section is determined from individual distances in upward and downward directions from a fire floor which is previously determined based on an operation, a fire resistance performance of a building or the like and the fire floor information. For example, when a fire floor is represented by F, a distance in an upward direction is represented by $\alpha$ and a distance in a downward direction is represented by $\beta$, the in-fire stop prohibition section is a section from an $F-\beta$ floor to an $F+\alpha$ floor. Next, a section obtained by an extension by a safety margin distance portion in a running direction of a car or both directions in the in-fire stop prohibition section is set to be an in-fire blocking section. For example, the safety margin distance is represented by γ, a portion from an F−β−γ floor to an F+α+γ floor is set to be the in-fire blocking section.

In Step S21, the in-fire blocking controller 46 decides whether a car is present in the in-fire blocking section or not based on car position information possessed by each of the car control devices 3U, 3M and 3D, and ends the processing if no car is present in the in-fire blocking section. In the case where the car is present in the in-fire blocking section, a stop command is transmitted to the car control devices 3U, 3M and 3D to be floors where an end on a running direction side of a car occupying section is adjacent to any of ends of the in-fire blocking section (Step S22) and the processing is ended. The car control devices 3U, 3M and 3D receiving the stop command stop the car.

Figure 11:
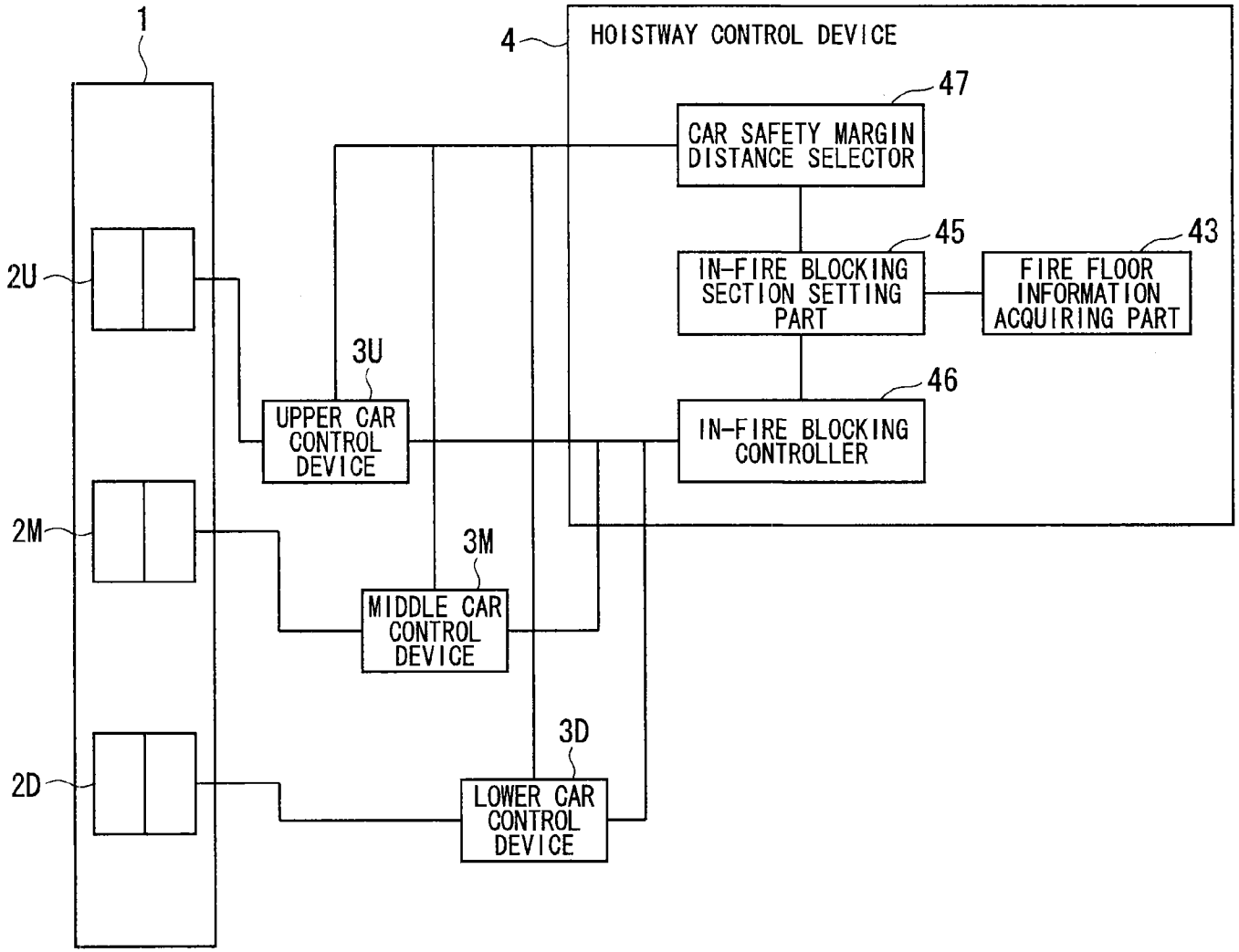
FIG. 11 is a diagram showing the structure of the multi-car elevator control device according to the second embodiment.

The safety margin distance provided between vicinal cars is determined based on speeds and accelerations of both of the cars. In some cases in which the speeds or accelerations of the respective cars are different from each other, therefore, the safety margin distance is varied between the cars. In these cases, the maximum one of the safety margin distances set to the respective cars running in the same shaft may be set as the safety margin distance between all of the cars in a lump. As shown in FIG. 11, alternatively, a predetermined safety margin distance determined based on the speeds and the accelerations of both of the vicinal cars (decelerations if they are negative) may be selected from a preset table by a car safety margin distance selector 47 provided in a hoistway control device 4, for example, and the safety margin distance thus selected may be given to the in-fire blocking section setting part 45, thereby setting an in-fire blocking section.

<Effect>

In the multi-car elevator control device according to the present embodiment, the following effect can be obtained as described above. In other words, the multi-car elevator control device according to the present embodiment controls an operation of each car in a multi-car elevator system in which a plurality of cars run along a single hoistway, and includes the fire floor information acquiring part 43 for acquiring fire floor information, the in-fire blocking section setting part 45 for setting an in-fire blocking section which permits only one car to run based on the fire floor information, and an in-fire blocking controller 46 for controlling other cars so as not to enter the in-fire blocking section when a single car is present in the in-fire blocking section. By controlling the car in such a manner that only one car is present in the in-fire blocking section provided within a predetermined range from a fire floor, even in the case where a front car stops on a floor placed in the vicinity of the fire floor for some reason, it is possible to cause a rear car to stop in a place other than the in-fire stop prohibition section, thereby escaping a passenger to an outside of the car. Moreover, a section of a distance fixed to the fire floor is set as the in-fire blocking section. Therefore, it is possible to constitute the in-fire blocking section setting part and the in-fire blocking controller by an electrical circuit such as a relay as well as an electronic circuit having a logic.

In the multi-car elevator control device according to the present embodiment, moreover, the in-fire blocking section setting part 45 sets, as the in-fire blocking section, the section obtained by adding the predetermined safety margin distance to the in-fire stop prohibition section being the floor within the predetermined range including the fire floor. Therefore, even in the case where the front car stops on the floor in the vicinity of the fire floor for some reason, the rear car stops in the place other than the in-fire stop prohibition section, allowing a passenger to escape to an outside of the car.

Furthermore, the safety margin distance constituting the in-fire blocking section is determined based on the speed and the acceleration of the car. With such a structure, however, in the case where the front car stops on the floor in the vicinity of the fire floor for some reason, the rear car stops in the place other than the in-fire stop prohibition section, allowing the passenger to escape to the outside of the car.

(Third Embodiment)

A multi-car elevator control device according to a third embodiment is a variant of the multi-car elevator control device according to the first embodiment. As shown in part (a) of FIG. 2, in the case where a running-enabled section is not present between a restraining partner car occupying section and an in-fire stop prohibition section but a safety margin section is present, a speed and a deceleration of a self car are decreased to shorten a safety margin section, thereby setting a running-enabled section between the restraining partner car occupying section and an in-fire prohibition section.

Here, the safety margin section is determined as a section from an adjacent floor in a direction in which a self car is present in the restraining partner car occupying section to a position on this side of a predetermined safety margin distance portion. The safety margin distance is determined based on the speeds and decelerations of the self car and the restraining partner car. In other words, therefore, the safety margin section is determined based on the speeds and decelerations of the self car and the restraining partner car.

Figure 12:
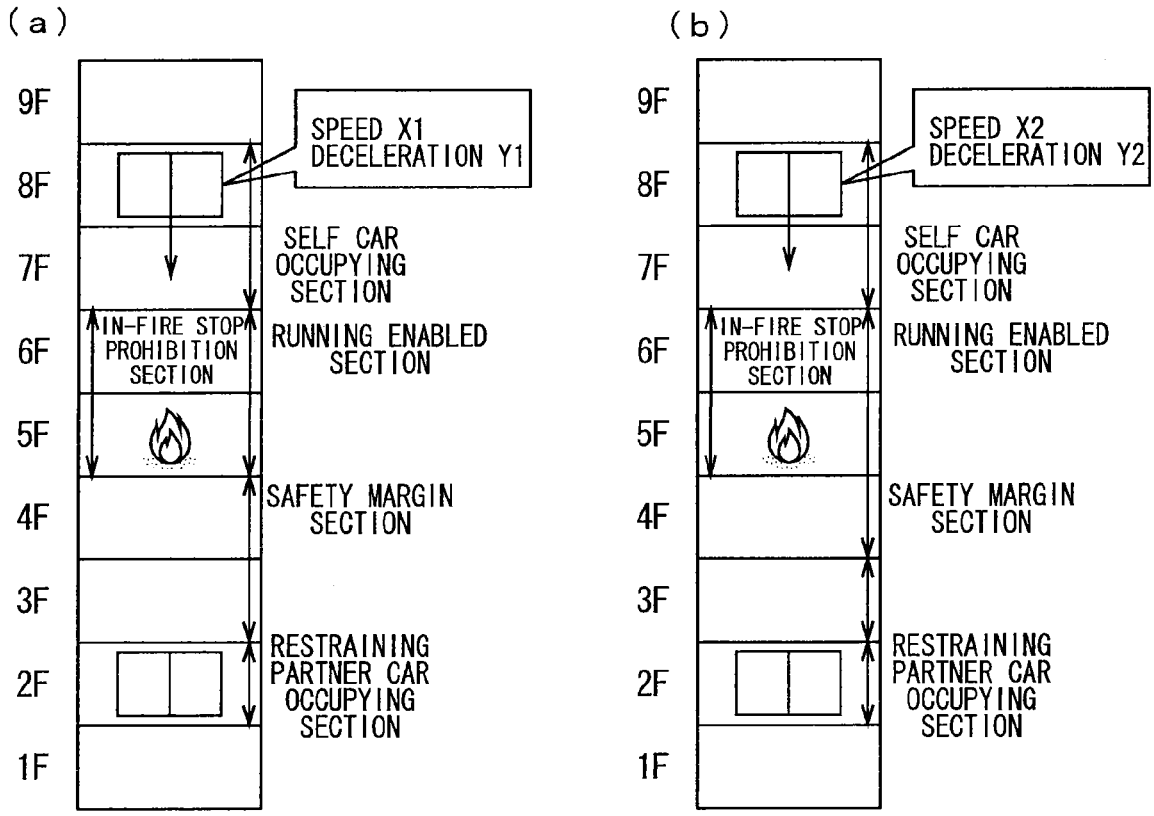
FIG. 12 is a conceptual view showing an operation control in a fire in a multi-car elevator control device according to a third embodiment.

Part (a) of FIG. 12 shows an example in which a fire occurs on 5F and the restraining partner car remains at rest on 2F. A restraining partner car occupying section is set to be 2F and the in-fire stop prohibition section is set to be 5 and 6F. The self car is running in 8F at a speed X1 and the deceleration thereof is set to be Y1. At this time, a self car occupying section has 7 and 8F. If the restraining partner car stops and the safety margin distance corresponds to two floors when the self car has the speed X1 and the deceleration Y1, the safety margin section has 3 and 4F so that the running-enabled section cannot be set between the in-fire stop prohibition section and the restraining partner car occupying section.

In such a case, in the multi-car elevator control device according to the present embodiment, the speed and the deceleration of the self car are changed into X2 and Y2 which have smaller vales than X1 and Y1 respectively to shorten the safety margin distance into a single floor portion as shown in part (b) of FIG. 12. Here, the safety margin distance is predetermined based on the speeds, decelerations and car conditions of the self car and the restraining partner car. As a result, the safety margin section is shortened from 2F to 3F into 3F. Therefore, 4F is set as a running-enabled section between the in-fire stop prohibition section and the restraining partner car occupying section so that the self car can run toward 4F.

The safety margin distance is shortened by a reduction in the speed and the deceleration. If the speed and the deceleration of the car is excessively reduced, however, a time required for a passage of the self car through the in-fire stop prohibition section is prolonged so that a sense of anxiety of a passenger is increased. Therefore, it is desirable to set the shortest time for the passage through the in-fire stop prohibition section from a combination of the speed and the deceleration of the self car such that the running-enabled section is set between the in-fire stop prohibition section and the restraining partner car occupying section.

Figure 13:
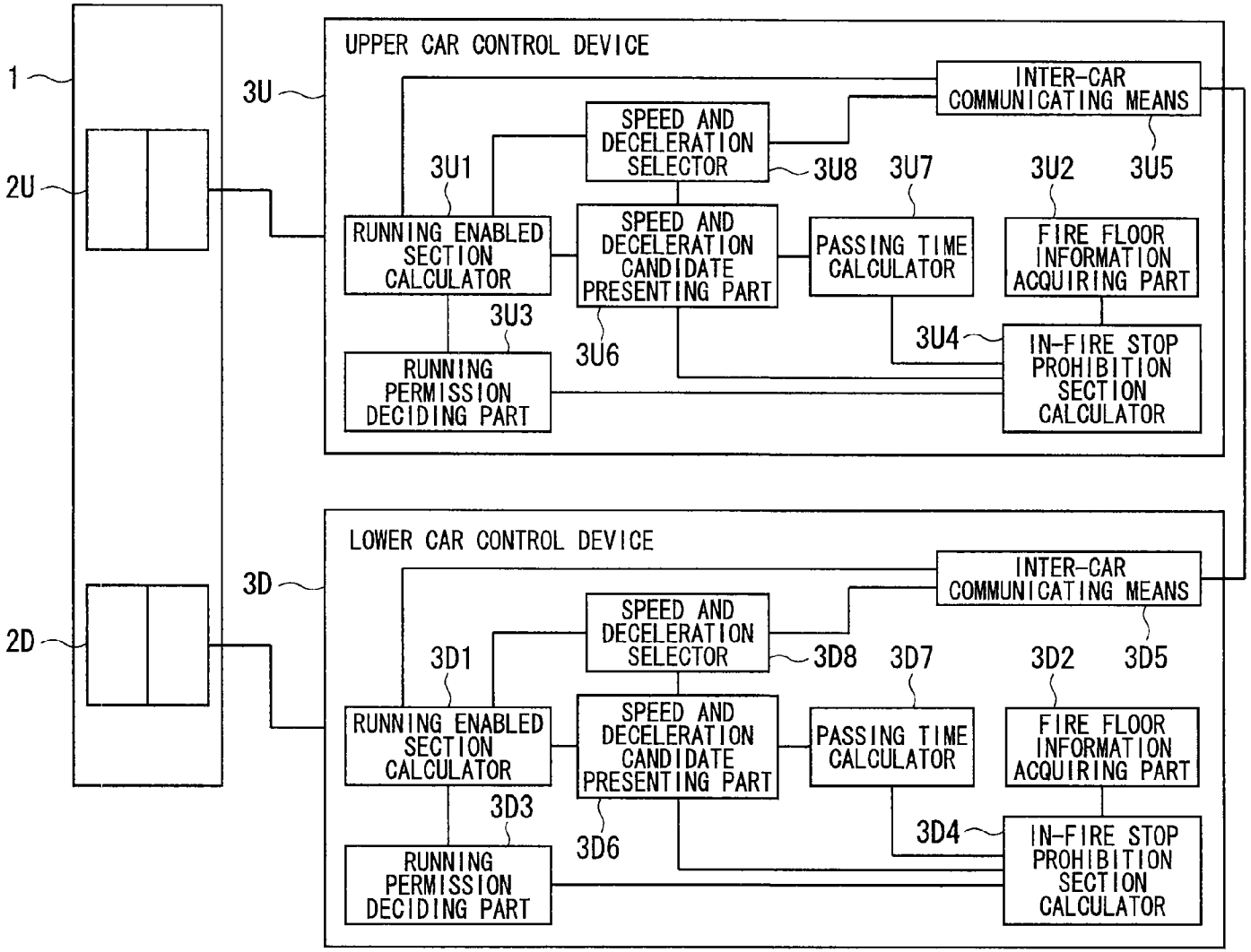
FIG. 13 is a diagram showing a structure of the multi-car elevator control device according to the third embodiment.

FIG. 13 is a diagram showing a structure of the multi-car elevator control device according to the third embodiment. The multi-car elevator control device according to the third embodiment further includes a speed and deceleration candidate presenting part 3U6, a passing time calculator 3U7, and a speed and deceleration selector 3U8 in an upper car control device 3U in addition to the structure of the multi-car elevator control device according to the first embodiment shown in FIG. 3. The speed and deceleration candidate presenting part 3U6 presents a candidate for a combination of a speed and a deceleration of a self car (that is, an upper car 2U) which can reduce the safety margin section to set the running-enabled section that does not overlap with the in-fire stop prohibition section when the running-enabled section wholly overlaps with the in-fire stop prohibition section. Here, it is also possible to select the candidate from the combination of the speed and the deceleration of the self car which are previously given. The passing time calculator 3U7 calculates a time required for the passage of the self car through the in-fire stop prohibition section (a passing time) in the case where each candidate for the combination of the speed and the deceleration presented by the speed and deceleration candidate presenting part 3U6 is applied. The speed and deceleration selector 3U8 selects, as a speed and a deceleration of the self car which are new, a candidate having the shortest passing time which is calculated by the passing time calculator 3U7.

Likewise, in a lower car control device 3D, there are provided a speed and deceleration candidate presenting part 3D6, a passing time calculator 3D7 and a speed and deceleration selector 3D8.

Since the other structures are the same as those in the first embodiment, description will be omitted.

Figure 14:
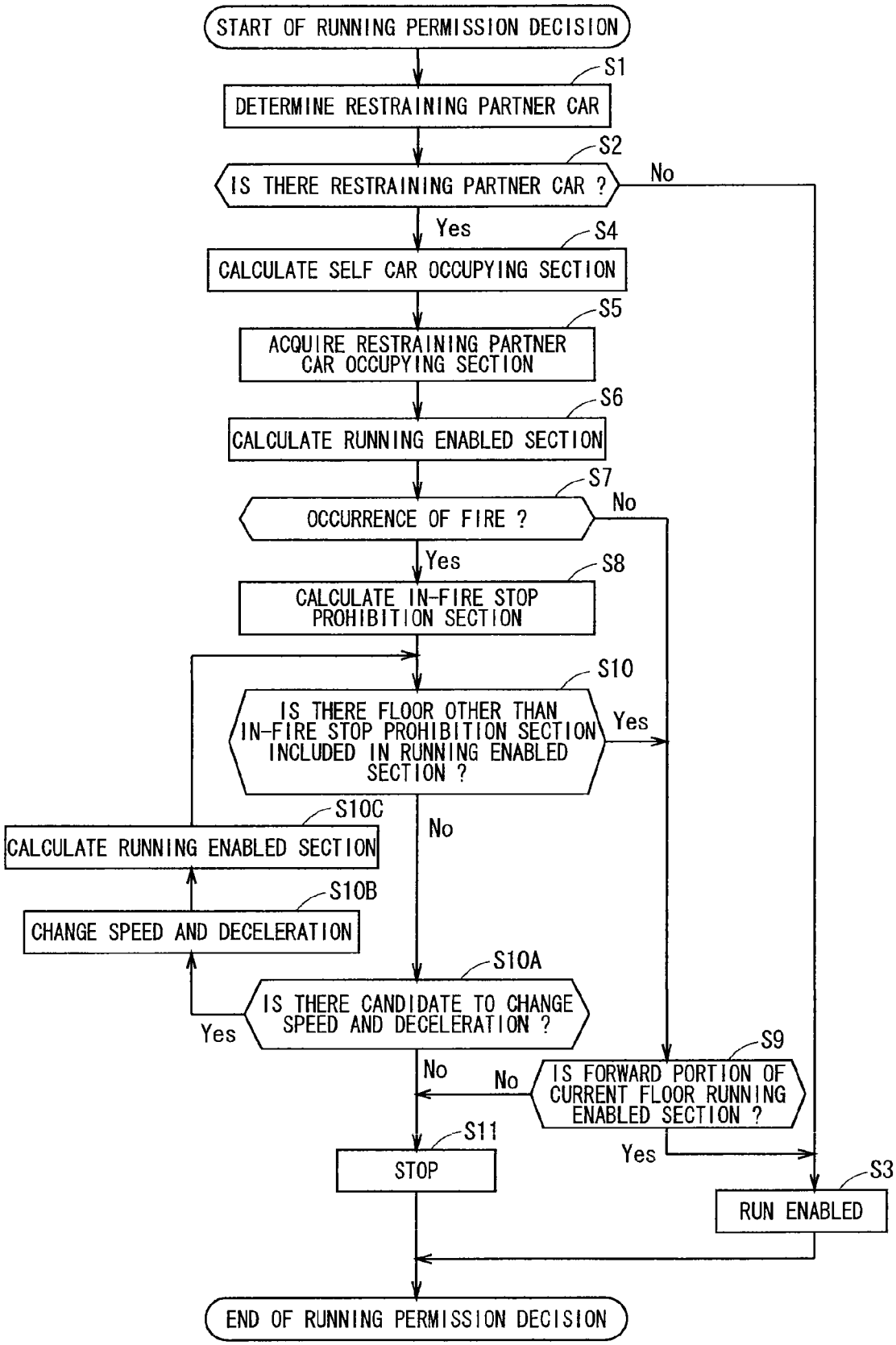
FIG. 14 is a flow chart showing an operation of the multi-car elevator control device according to the third embodiment.

FIG. 14 is a flow chart for a decision of a running permission which is to be carried out by the multi-car elevator control device according to the third embodiment. Since operations other than the Steps S10A to S10C are the same as those of the flow chart according to the first embodiment shown in FIG. 4, description will be omitted. Moreover, explanation will be given by taking, as an example, the case in which an upper car is a self car.

In the case where a floor other than the in-fire stop prohibition section is not included in the running-enabled section (NO in Step S10), the speed and deceleration candidate presenting part 3U6 confirms whether there are candidates for a speed and a deceleration other than the speed and the deceleration which are currently set or not. When there are other candidates, the processing proceeds to Step S10B. When there is no candidate, the car is caused to stop (Step S11).

The speed and the deceleration of the self car are changed in the following manner in Step S10B. The speed and decoration candidate presenting part 3U6 selects a candidate which can set a running-enabled section between the in-fire stop prohibition section and the restraining partner car occupying section from the candidates for the combination of the speed and the deceleration of the self car which are given in advance based on a state such as the restraining partner car occupying section, the in-fire stop prohibition section, the car position of the self car, the speed or the like which is obtained through inter-car communicating means 3U5. The passing time calculator 3U7 calculates a time required for a passage through the in-fire stop prohibition-section (a passing time) for each of the candidates for the speed and the deceleration of the self car which are selected by the speed and deceleration candidate presenting part 3U6. The speed and deceleration selector 3U8 selects a speed and a deceleration at which the time for the passage through the in-fire stop prohibition section calculated by the passing time calculator 3U7 is minimized from the candidates for the combination of the speed and the deceleration of the self car selected by the speed and deceleration candidate presenting part 3U6, and sets them as a speed and a deceleration of the self car which are new.

Next, the running-enabled section of the self car is calculated again in accordance with the speed and the deceleration which are changed (Step S10C) and the processing returns to the Step S10.

<Effect>

In the multi-car elevator control device according to the third embodiment, running-enabled section calculators 3U1 and 3D1 calculate, as a running-enabled section, a section between a safety margin section provided adjacently to a self car side of a front car occupying section and a self car occupying section, the safety margin section is determined based on the speed and the deceleration of the car, and running permission deciding parts 3U3 and 3D3 permit a running operation only when there is any of the running-enabled sections which does not overlap with the in-fire stop prohibition section and further include the speed and deceleration candidate presenting parts 3U6 and 3D6 for presenting a candidate for a combination of the speed and deceleration of the car which reduces the safety margin section when the whole running-enabled section overlaps with the in-fire stop prohibition section, the passing time calculators 3U1 and 3D1 for calculating the passing time required for the passage through the in-fire stop prohibition section when the candidate is used, and the speed and deceleration selectors 3U8 and 3D8 for selecting the candidate having the shortest passing time as a speed and a deceleration of the self car which are new. Therefore, it is possible to allow the car to run more quickly in a forward direction from the in-fire stop prohibition section.

(Fourth Embodiment)

A multi-car elevator control device according to a fourth embodiment is obtained by applying the technique for regulating the speed and the deceleration of the self car which has been described in the third embodiment to the multi-car elevator control device according to the second embodiment. In other words, in the case where a car is present in an in-fire blocking section as shown in part (a) of FIG. 7 or part (a) of FIG. 8, a speed and a deceleration of a car having an in-fire blocking section adjacently to an end in a running direction of an occupying section, that is, the car of 7F in part (a) of FIG. 7 or the car of 8F in part (a) of FIG. 8 are decreased to shorten a safety margin distance, thereby shortening the in-fire blocking section, whereby there is no car in the in-fire blocking section. Here, a car to be a target for regulating the speed and the deceleration is defined as a blocking stop target car.

Figure 15:
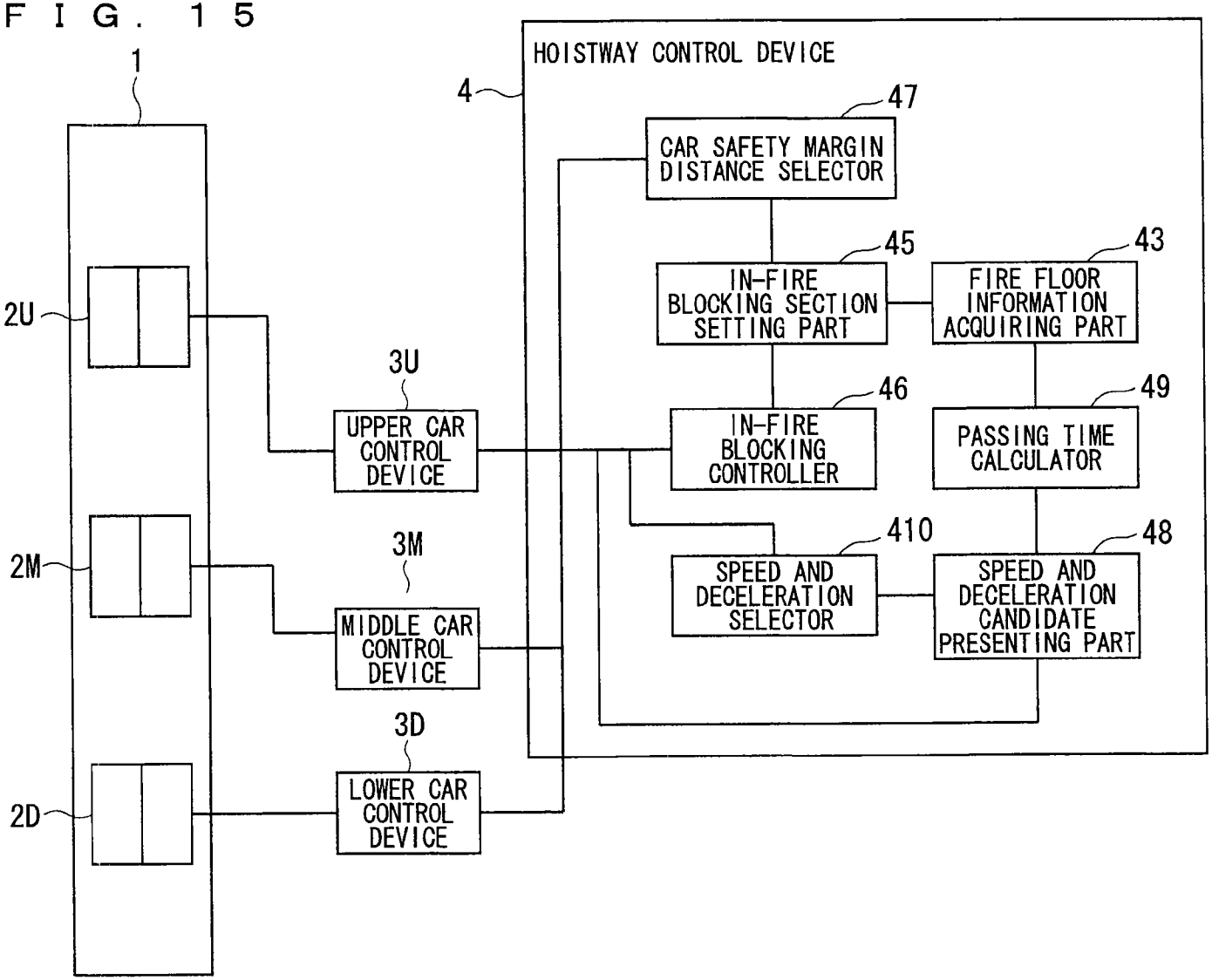
FIG. 15 is a diagram showing a structure of a multi-car elevator control device according to a fourth embodiment.

FIG. 15 is a diagram showing a structure of the multi-car elevator control device according to the fourth embodiment. The structure of the multi-car elevator control device according to the fourth embodiment includes a speed and deceleration candidate presenting part 48 for presenting a candidate for a combination of a speed and a deceleration of a blocking stop target car, a passing time calculator 49 for calculating a time required for the blocking stop target car to pass through the in-fire blocking section, and a speed and deceleration selector 410 for determining the combination of the speed and the deceleration of the blocking stop target car, in addition to the structure of the multi-car elevator control device according to the second embodiment shown in FIG. 11. Since the other structures are the same as those in the second embodiment, description will be omitted.

Figure 16:
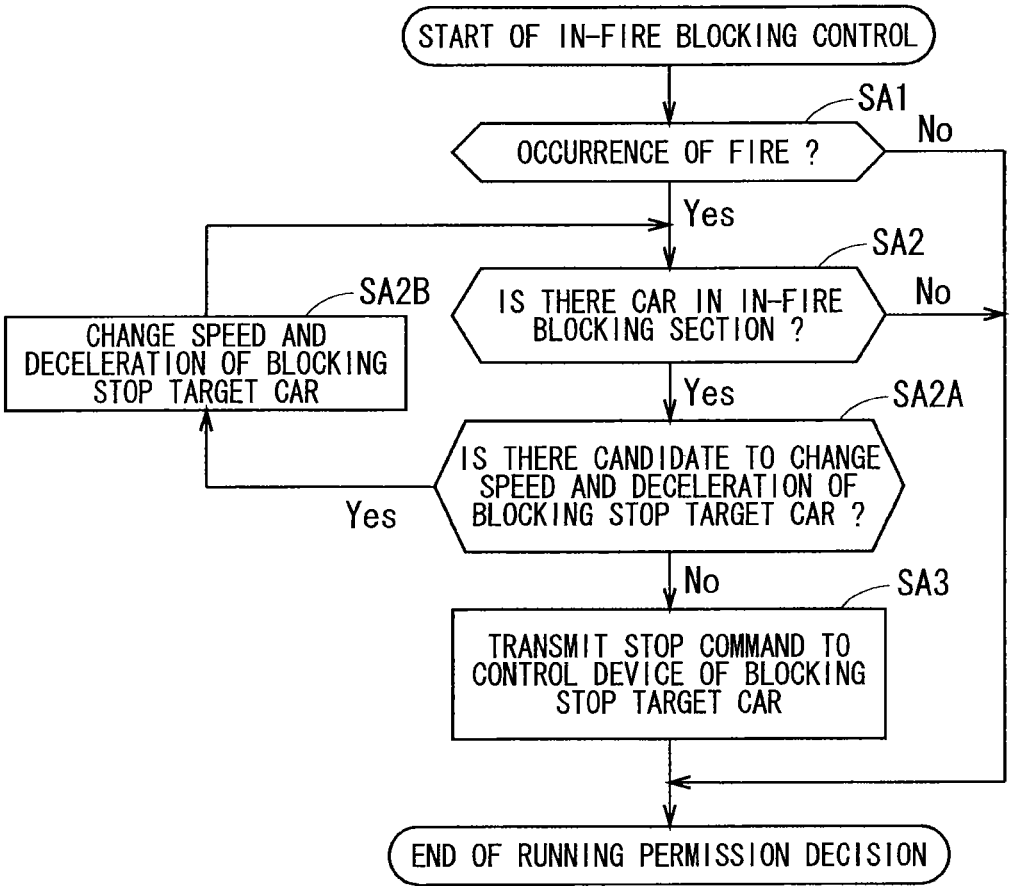
FIG. 16 is a flow chart showing an operation of the multi-car elevator control device according to the fourth embodiment.

FIG. 16 is a flow chart showing an in-fire blocking control to be carried out by the multi-car elevator control device according to the fourth embodiment. In FIG. 16, steps other than Steps SA2A and SA2B are the same as those in FIG. 12 according to the second embodiment. Therefore, only the Steps SA2A and SA2B will be described.

If a car is present in the in-fire blocking section (Yes in Step SA2), it is confirmed whether there is a candidate for a speed and a deceleration other than a speed and a deceleration which are currently set to a blocking stop target car or not (Step SA2A). If there are other candidates, the processing proceeds to the Step SA2B. If there is no candidate, a stop command is transmitted to a control device of the blocking stop target car (Step SA3). The speed and the deceleration of the blocking stop target car are changed in the following manner in Step SA2B, and the processing then returns to Step SA2.

In Step SA2B, the speed and deceleration candidate presenting part 48 presents a candidate for a combination which can shorten the in-fire blocking section. For example, the candidate may be selected from combinations of the speed and deceleration of the blocking stop target car which are given in advance based on a state such as an in-fire blocking section, a car position and speed of the blocking stop target car, or the like. The passing time calculator 49 calculates a time (a passing time) required for the blocking stop target car to pass through the in-fire stop prohibition section in the case where each of the candidates for the speed and the deceleration of the blocking stop target car which are presented by the speed and deceleration candidate presenting part 48 is used. The speed and deceleration selector 410 selects the speed and the deceleration of the blocking stop target car at which the passing time calculated by the passing time calculator 49 is minimized in the combinations of the speed and the deceleration of the blocking stop target car which are selected by the speed and deceleration candidate presenting part 48, and sets them as a speed and an acceleration of the blocking stop target car which are new.

<Effect>

The multi-car elevator control device according to the fourth embodiment further includes the speed and deceleration candidate presenting part 48 for presenting a candidate for a combination of a speed and a deceleration of a blocking stop target car which reduces the in-fire blocking section, the passing time calculator 49 for calculating a passing time required for the blocking stop target car to pass through the in-fire blocking section when the candidate is used, and the speed and deceleration selector 410 for selecting the candidate having the shortest passing time as a speed and a deceleration of the blocking stop target car which are new. Therefore, it is possible to cause the blocking stop target car to run more quickly in a forward direction from the in-fire stop prohibition section while reducing a situation in which the car is to stop due to the in-fire blocking section.

(Fifth Embodiment)

A multi-car elevator control device according to a fifth embodiment is implemented by the multi-car elevator control device according to the first embodiment which has an in-fire departure control function. The in-fire departure control predicts future positions of a self car and a restraining partner car from a position of the self car, a position of the restraining partner car, a speed, a direction, a door condition and an in-fire stop prohibition section and controls a departure timing of the self car based on a result of the prediction in order to prevent the car from stopping in the middle due to the in-fire stop prohibition section.

Figure 17:
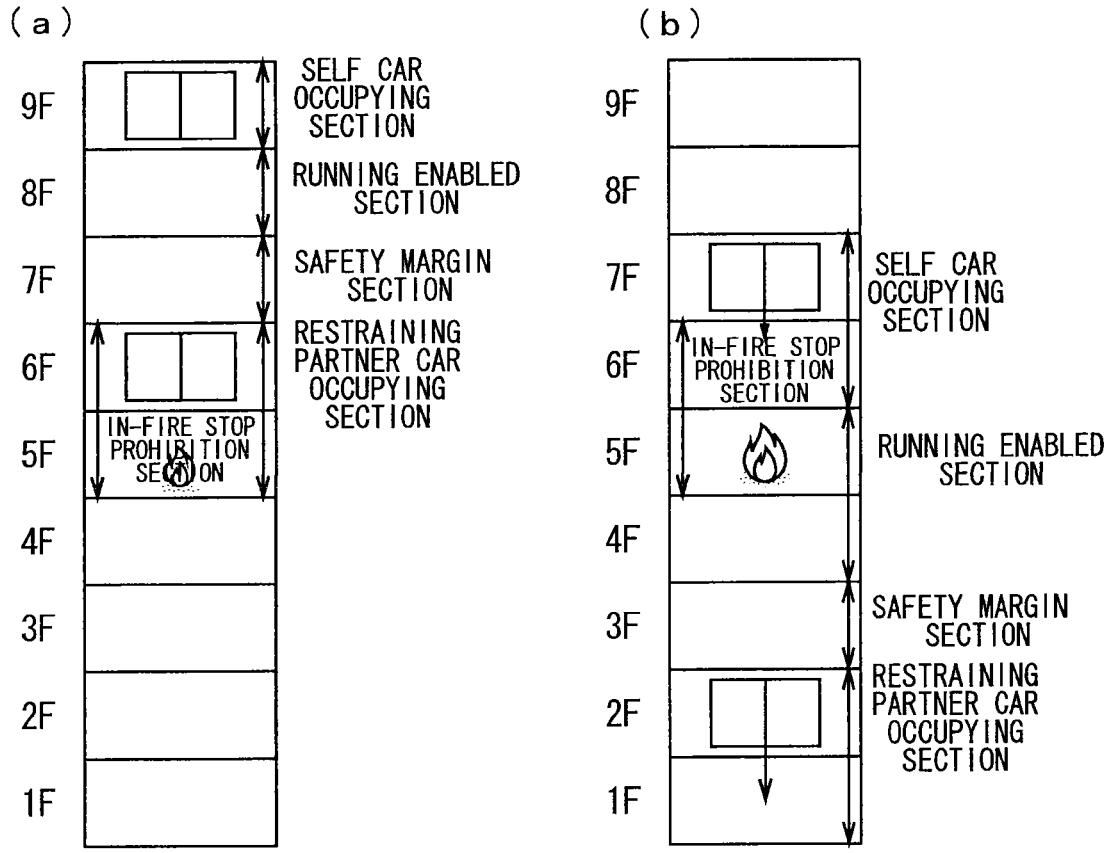
FIG. 17 is a conceptual view showing an operation control in a fire in a multi-car elevator control device according to a fifth embodiment.

Part (a) of FIG. 17 shows an example in which a fire occurs on 5F and the restraining partner car is moving from 6F to 5F. A restraining partner car occupying section has 5F and 6F, and the in-fire stop prohibition section is also set to be 5F and 6F. The self car stops on 9F and a self car occupying section has 9F. If a safety margin distance corresponds to one floor portion, a safety margin section has 7F and a running-enabled section has 8F. 8F is present as the running-enabled section which does not overlap with the in-fire stop prohibition section. Therefore, the self car can depart from 9F and can run toward 8F. However, upon the self car reaching 7F adjacent to the in-fire stop prohibition section, if the running-enabled section is not present between the restraining partner car occupying section and the in-fire stop prohibition section, the self car is to stop on 7F which is a floor placed just above the in-fire stop prohibition section.

In such a case, in the multi-car elevator control device according to the present embodiment, a departure time of the self car is adjusted in such a manner that the self car enters the in-fire stop prohibition section at a timing when the running-enabled section is created between the restraining partner car occupying section and the in-fire stop prohibition section as shown in part (b) of FIG. 17. Consequently, the self car is allowed to pass through the in-fire stop prohibition section without a stop after a departure.

Figure 18:
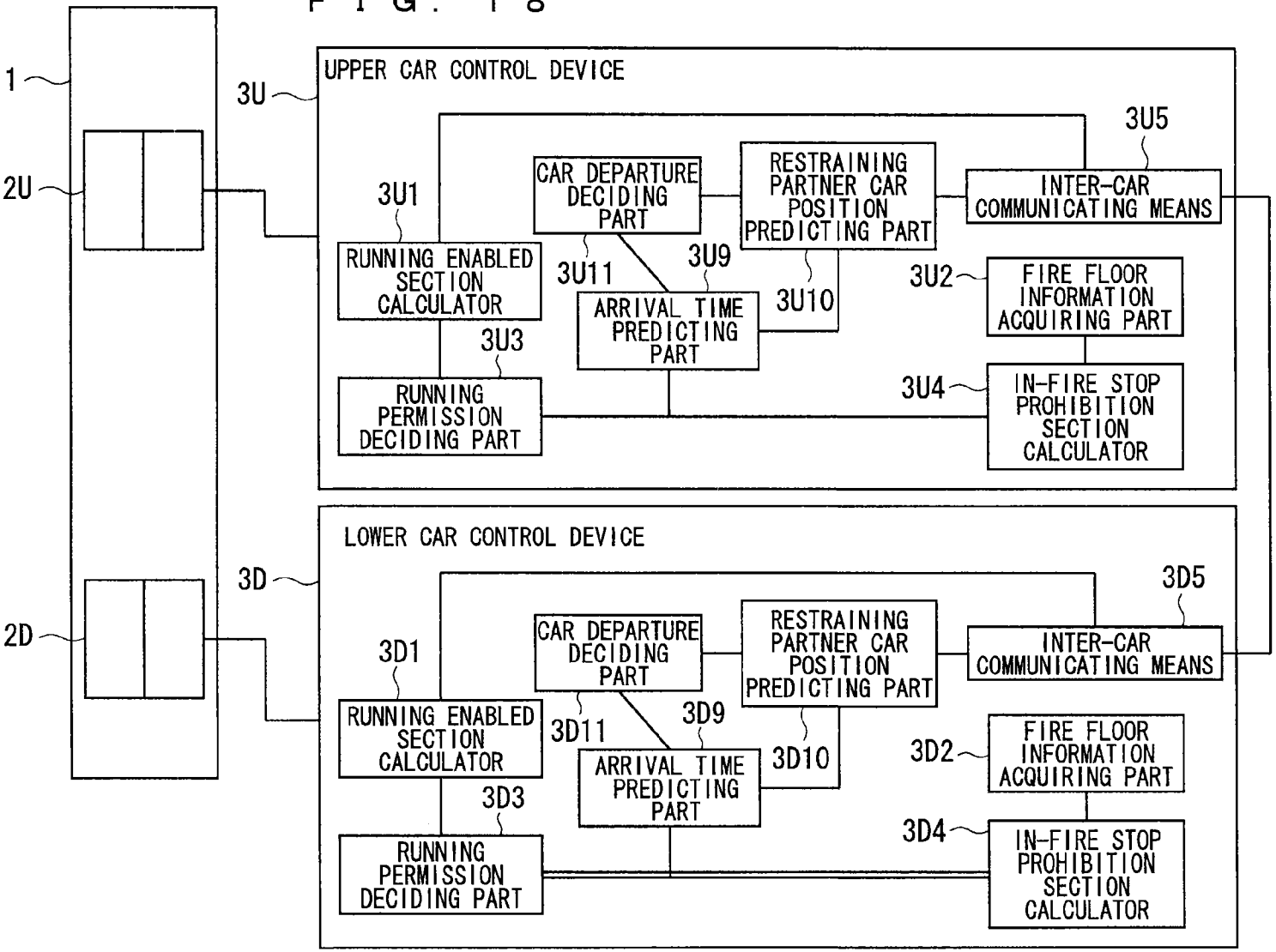
FIG. 18 is a diagram showing a structure of the multi-car elevator control device according to the fifth embodiment.

FIG. 18 is a diagram showing a structure of the multi-car elevator control device according to the fifth embodiment. The multi-car elevator control device according to the fifth embodiment further includes an arrival time predicting part 3U9 for predicting a time when the self car arrives at the in-fire stop prohibition section, a restraining partner car position predicting part 3U10 for predicting a position of the restraining partner car at the arrival time, and a car departure deciding part 3U11 for controlling a departure timing of the self car in an upper car control device 3U in addition to the structure of the multi-car elevator control device according to the first embodiment shown in FIG. 3.

Figure 19:
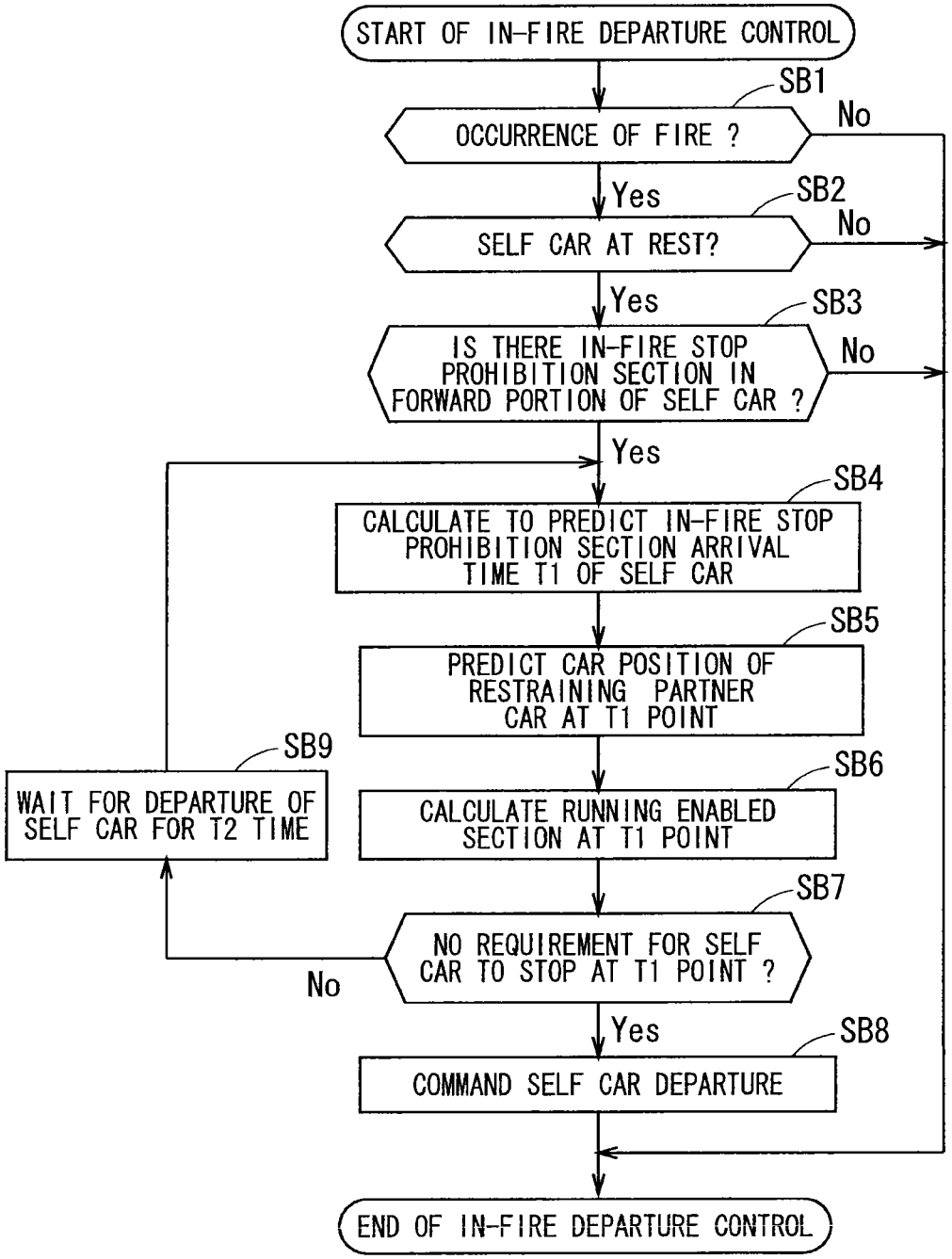
FIG. 19 is a flow chart showing an operation of the multi-car elevator control device according to the fifth embodiment.

FIG. 19 is a flow chart showing an in-fire departure control to be carried out by the multi-car elevator control device according to the fifth embodiment. Here, explanation will be given to an example in which an upper car is the self car.

First of all, it is decided whether a fire occurs or not (Step SB1). If the fire does not occur, the processing is ended. If the fire occurs, it is decided whether the self car remains at rest or not (Step SB2). If the self car is running, the processing is ended. If the self car remains at rest, it is decided whether the in-fire stop prohibition section is present in a forward portion of the self car or not. If the in-fire stop prohibition section is not present, the processing is ended. If the in-fire stop prohibition section is present, the processing proceeds to Step SB4.

In Step SB4, a time T1 when the self car arrives at the in-fire stop prohibition section is predictively calculated by the arrival time predicting part 3U9. The present prediction is carried out depending on a state of door opening/closing of the self car, a position of the self car, a speed of the self car, a stop intended floor of the self car, or the like.

Next, a position of the restraining partner car at the time T1 point is predicted by the restraining partner car position predicting part 3U10 (Step SB5). The present prediction is carried out depending on a state of door opening/closing, a position, a speed, a stop intended floor of the restraining partner car, or the like.

Then, a running-enabled section of the self car at the time T1 point is calculated (Step SB6), and it is decided whether the self car needs to stop at the time T1 point or not (Step SB7). More specifically, the stop is not required if the running-enabled section is present between the restraining partner car occupying section and the in-fire stop prohibition section at the time T1 point, and the stop is required if the running-enabled section is not present between the restraining partner car occupying section and the in-fire stop prohibition section.

If it is decided that the self car does not need to stop, a departure command is given to the self car (Step SB8). If it is decided that the self car needs to stop, a departure is waited for a predetermined time T2 (Step SB9) and the processing returns to the Step SB4 to repeat the processing. As a result, the self car waits for the departure until a section which does not overlap with the in-fire stop prohibition section is formed in the running-enabled section at the time for the arrival at the in-fire stop prohibition section. The processings of the Steps SB6 to SB9 are executed by the car departure deciding part 3U11.

Although the description has been given on the assumption that the multi-car elevator control device according to the present embodiment is implemented by the multi-car elevator control device according to the first embodiment which has an in-fire departure control function, the in-fire departure control function can also be applied to the multi-car elevator control device according to the third embodiment.

<Effect>

According to the multi-car elevator control device in accordance with the fifth embodiment, there are provided arrival time predicting parts 3U9 and 3D9 for predicting a time when the self car intended for a departure arrives at the in-fire stop prohibition section, restraining partner car position predicting parts 3U10 and 3D10 (front car position predicting parts) for predicting a position of the restraining partner car (a front car) at the arrival time, and a car departure deciding part 3U11 for calculating a running-enabled section of the self car at the arrival time from the arrival time and the position of the front car at the arrival time and waiting for the departure of the self car until a section which does not overlap with the in-fire stop prohibition section is formed in the running-enabled section. Therefore, it is not necessary to stop the car on a close floor to a fire floor in the middle of a running operation. Consequently, it is possible to decrease a sense of impatience of a passenger in the car.

(Sixth Embodiment)

A multi-car elevator control device according to a sixth embodiment is implemented by the multi-car elevator control device according to the second embodiment which has an in-fire departure control function. The in-fire departure control predicts future positions of a self car and a front car based on a position of the self car, a position of the front car, a speed, a direction, a door condition and an in-fire stop prohibition section and controls a running start timing of the self car on the basis of a result of the prediction in order to prevent the car from stopping in the middle due to an in-fire blocking section.

Figure 20:
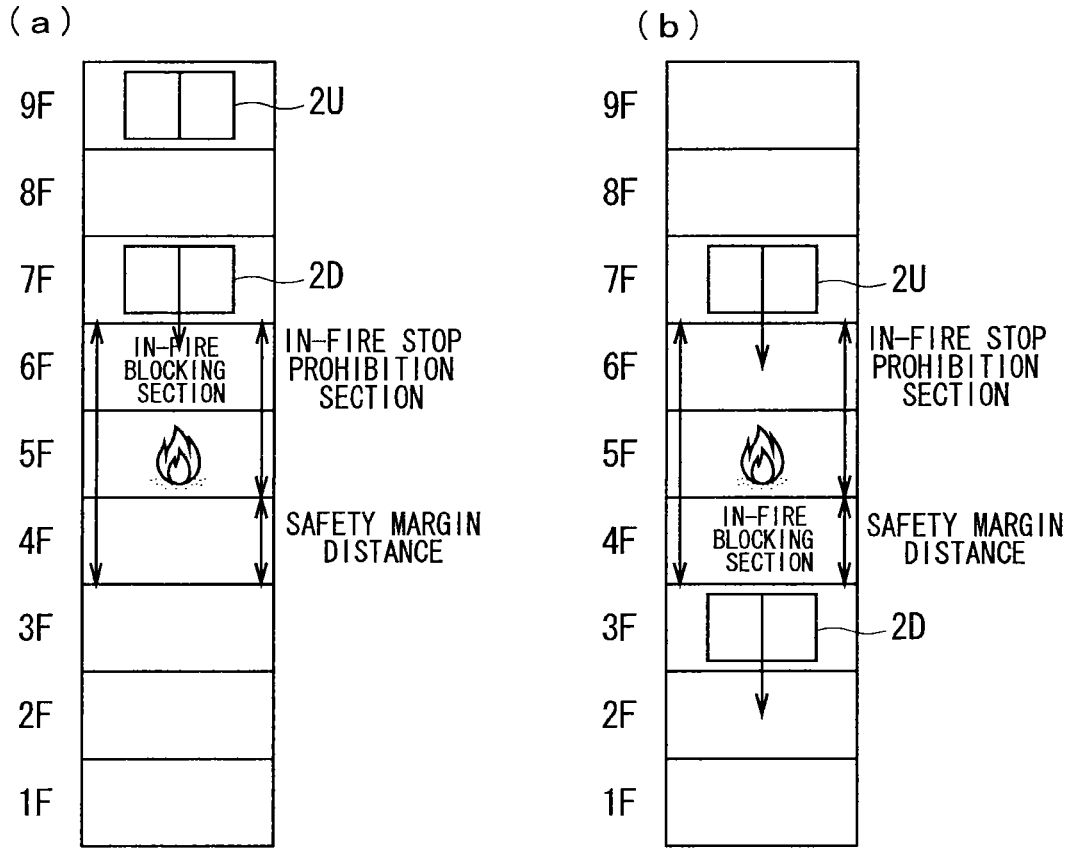
FIG. 20 is a conceptual view showing an operation control in a fire in a multi-car elevator control device according to a sixth embodiment.

Part (a) of FIG. 20 shows an example in which a fire occurs on 5F and a lower car 2D is moving through 7F. If the in-fire stop prohibition section is set to be 5F and 6F and a safety margin distance corresponds to one floor portion, the in-fire blocking section is set to be 4 to 6F. An upper car 2U stopping on 9F can move toward 8F. If the lower car 2D is still present in the in-fire blocking section when the upper car 2U arrives at 7F, however, the upper car 2U is to stop in 7F.

In such a case, in the multi-car elevator control device according to the present embodiment, a departure time of the upper car 2U is controlled in such a manner that the upper car 2U enters the in-fire blocking section at a timing when the lower car 2D completes passing through the in-fire blocking section as shown in part (b) of FIG. 20. Consequently, the upper car 2U is allowed to pass through the in-fire stop prohibition section without a stop after a departure.

Figure 21:
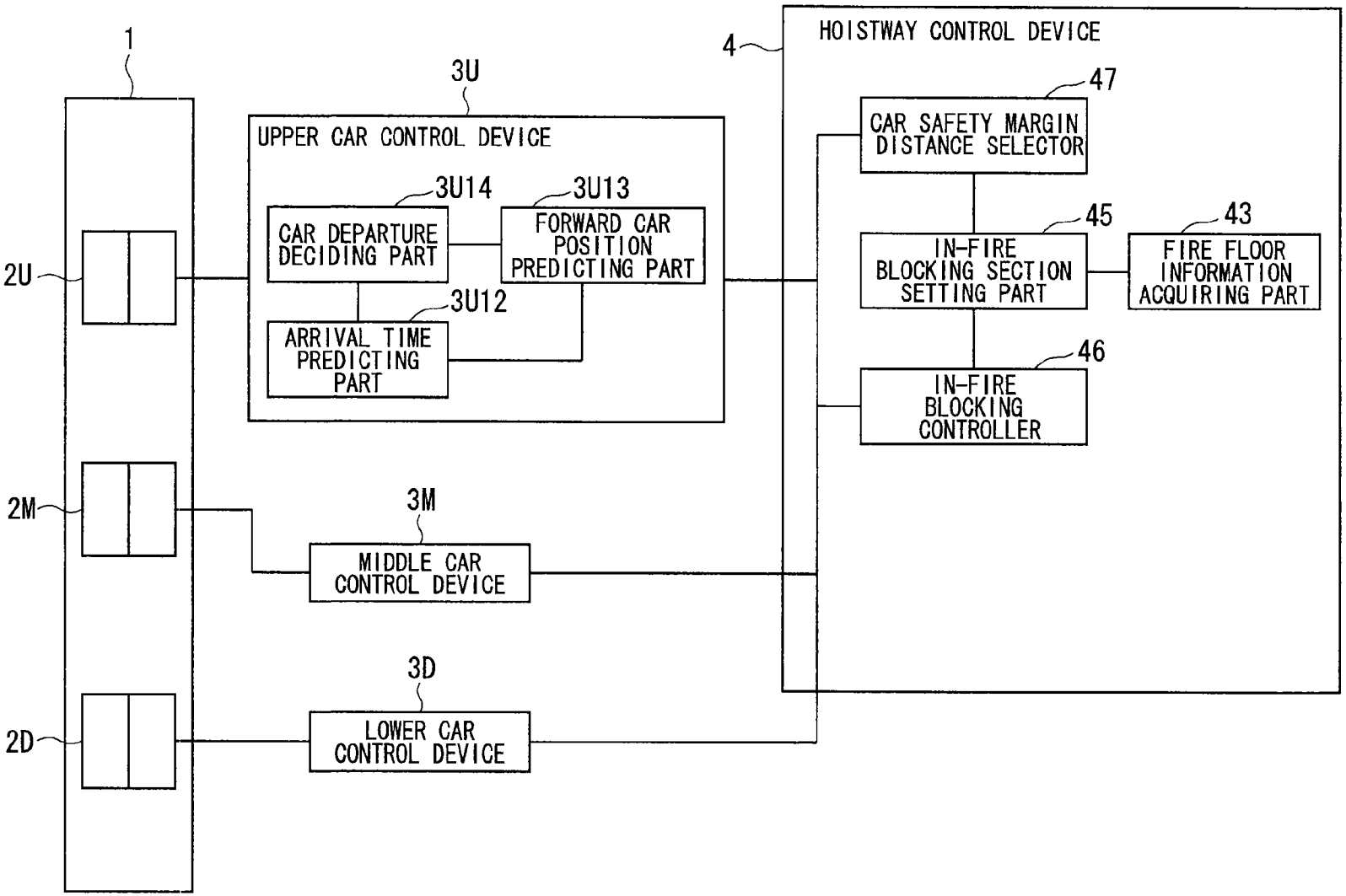
FIG. 21 is a diagram showing a structure of the multi-car elevator control device according to the sixth embodiment.

FIG. 21 is a diagram showing a structure of the multi-car elevator control device according to the sixth embodiment. The multi-car elevator control device according to the sixth embodiment further includes an arrival time predicting part 3U12 for predicting a time when the self car arrives at the in-fire blocking section, a front car position predicting part 3U13 for predicting a position of the front car at the arrival time, and a car departure deciding part 3U14 for controlling a departure timing of the self car in an upper car control device 3U in addition to the structure of the multi-car elevator control device according to the second embodiment shown in FIG. 11. A middle car control device 3M and a lower car control device 3D are also provided with an arrival time predicting part, a front car position predicting part and a car departure deciding part respectively, which is not shown in FIG. 21. Since the other structures are the same as those in the second embodiment, description will be omitted.

Figure 22:
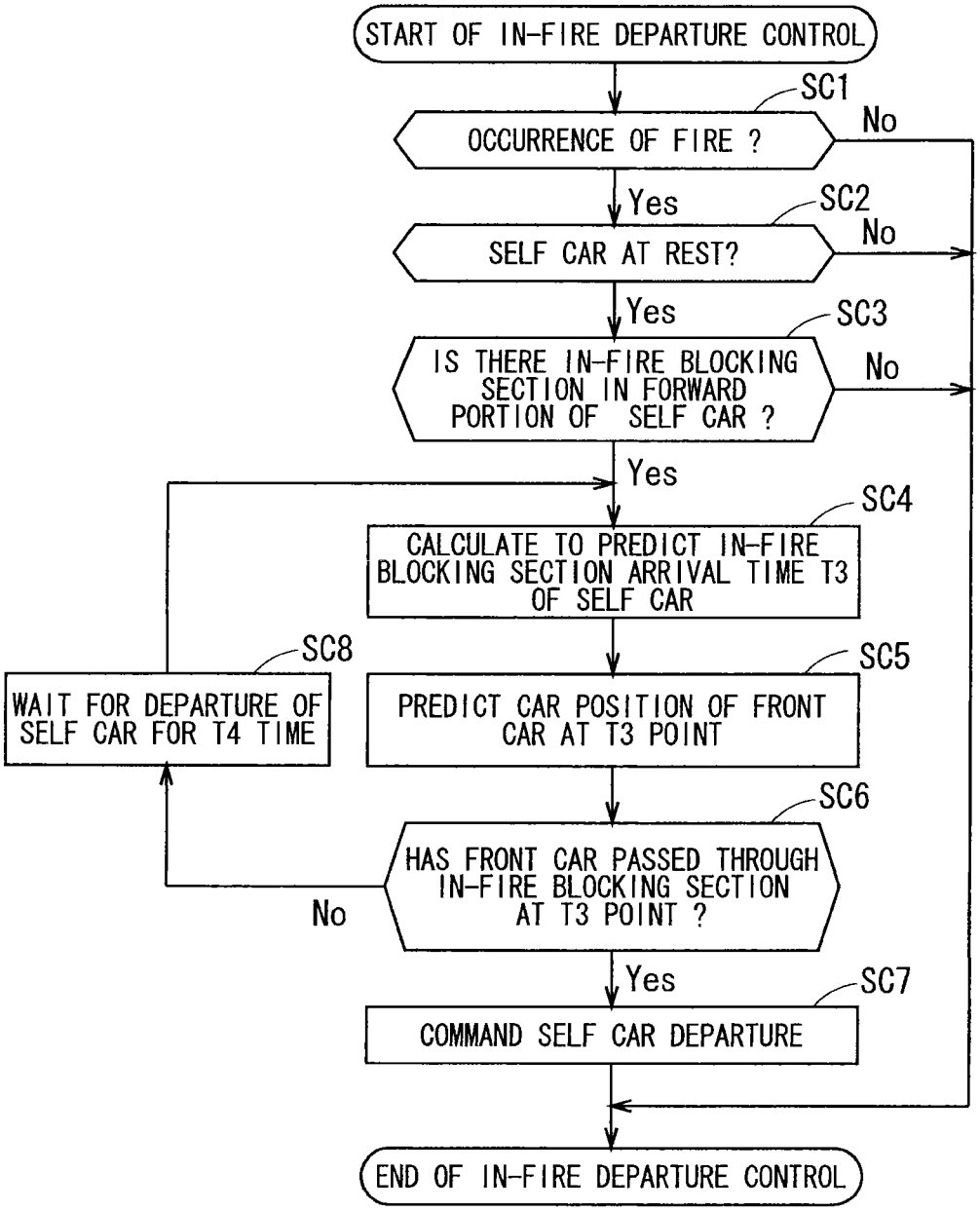
FIG. 22 is a flow chart showing an operation of the multi-car elevator control device according to the sixth embodiment.

FIG. 22 is a flow chart showing an in-fire departure control to be carried out by the multi-car elevator control device according to the sixth embodiment. Here, explanation will be given to an example in which a self car to be an in-fire departure control is an upper car.

First of all, it is decided whether a fire occurs or not (Step SC1). If the fire does not occur, the processing is ended. If the fire occurs, it is decided whether the self car remains at rest or not (Step SC2). If the self car is running, the processing is ended. If the self car remains at rest, it is decided whether the in-fire blocking section is present in a forward portion of the self car or not (Step SC3). If the in-fire blocking section is not present, the processing is ended. If the in-fire blocking section is present, the processing proceeds to Step SC4.

In Step SC4, a time T3 when the self car arrives at the in-fire blocking section is calculated to predict by the arrival time predicting part 3U12. The present prediction is carried out depending on a state of door opening/closing of the self car, a position of the self car, a speed of the self car, a stop intended floor of the self car, a state of door opening/closing, a position, a speed and a stop intended floor of the front car, or the like.

Next, a position of the front car at the time T3 point is predicted by the front car position predicting part 3U13 (Step SC5). The present prediction is carried out depending on the state of door opening/closing, position, speed and stop intended floor of the front car, or the like.

Then, it is decided whether the front car passes through the in-fire blocking section at the time T3 point (Step SC6). If the front car passes through the in-fire blocking section at the time T3 point, a departure command is given to the self car (Step SC7). If the front car does not pass therethrough, the departure of the front car is waited by a predetermined time T4 (Step SC8) and the processing returns to the Step SC4. Note that the processings of SC6 to SC8 are executed by the car departure deciding part 3U14.

Although the description has been given on the assumption that the multi-car elevator control device according to the second embodiment which has an in-fire departure control function is set to be the multi-car elevator control device according to the present embodiment, the in-fire departure control function can also be applied to the multi-car elevator control device according to the fourth embodiment.

<Effect>

According to the present invention, the standby of the car departure is carried out until it is not necessary to carry out the stop due to the in-fire blocking section. Therefore, it is not necessary to stop the car on a close floor to a fire floor in the middle of a running operation. Consequently, it is possible to decrease a sense of impatience of a passenger in the car.

According to the multi-car elevator control device in accordance with the sixth embodiment, there are provided the arrival time predicting part 3U12 for predicting the time T3 when the self car intended for a departure arrives at the in-fire blocking section, the front car position predicting part 3U13 for predicting a position of the front car at the arrival time T3, and the car departure deciding part 3U14 for properly waiting for the departure of the self car in such a manner that the self car arrives at the in-fire blocking section at such a timing when the front car passes through the in-fire blocking section. Therefore, it is not necessary to stop the car on a vicinal floor of the fire floor. Consequently, it is possible to decrease a sense of impatience of a passenger in the car.

While the invention has been shown and described in detail, the foregoing description is in all aspects illustrative and not restrictive. It is therefore understood that numerous modifications and variations can be devised without departing from the scope of the invention.

Explanation of Designation

1 hoistway, 2U, 2M, 2D car, 3U, 3M, 3D car control device, 3U1, 3M1, 3D1, 42U, 42M, 42D running-enabled section calculator, 3U2, 3M2, 3D2, 43 fire floor information acquiring part, 3U3, 3M3, 3D3, 41U, 41M, 41D running permission deciding part, 3U4, 3M4, 3D4, 44 in-fire stop prohibition section calculator, 3U5, 3M5, 3D5 inter-car communicating means, 3U6, 3D6, 48 speed and deceleration candidate presenting part, 3U7, 3D7, 49 passing time calculator, 3U8, 3D8, 410 speed and deceleration selector, 3U9, 3D9, 3U12 arrival time predicting part, 3U10, 3D10 restraining partner car position predicting part, 3U11, 3D11, 3U14 car departure deciding part, 3U13 front car position predicting part, 4 hoistway control device, 45 in-fire blocking section setting part, 46 in-fire blocking controller, 47 car safety margin distance selector.

The invention claimed is:

1. A multi-car elevator control device for controlling an operation of each of a plurality of cars in a multi-car elevator system in which said plurality of cars run along a single hoistway, comprising:

a running-enabled section calculator for calculating, as a running-enabled section, a range of a floor in which a stop can be carried out to open a door without a collision with a front car which stops;

a fire floor information acquiring part for acquiring fire floor information;

an in-fire stop prohibition section calculator for calculating a floor within a predetermined range including a fire floor as an in-fire stop prohibition section for prohibiting a stop of a car based on said fire floor information; and a running permission deciding part for allowing running of an elevator in a case where said running-enabled section includes a floor other than said in-fire stop prohibition section, and stopping a car in a case where said running-enabled section does not include a floor other than said in-fire stop prohibition section.

2. The multi-car elevator control device according to claim 1, wherein said in-fire stop prohibition section calculator sets, as an in-fire stop prohibition section, a range obtained by adding a predetermined distance in upward and downward directions from a position of a fire floor included in said fire floor information.

3. The multi-car elevator control device according to claim 1, wherein said running-enabled section calculator calculates, as said running-enabled section, a section between a safety margin section provided adjacently to a self car side of a front car occupying section and a self car occupying section, said safety margin section is determined based on a speed and a deceleration of a car, and said running permission deciding part permits a running operation only when a section which does not overlap with said in-fire stop prohibition section in said running-enabled section is present, said device further comprising:

a speed and deceleration candidate presenting part for presenting a candidate for a combination of a speed and a deceleration of a car which reduces said safety margin section when said running-enabled section wholly overlaps with said in-fire stop prohibition section;

a passing time calculator for calculating a passing time required for a passage through said in-fire stop prohibition section when said candidate is used; and a speed and deceleration selector for selecting said candidate having the shortest passing time as a speed and a deceleration of a self car which are new.

4. The multi-car elevator control device according to claim 1, further comprising:

an arrival time predicting part for predicting a time when a departure intended self car arrives at said in-fire stop prohibition section;

a front car position predicting part for predicting a position of a front car at said arrival time; and a car departure deciding part for calculating a running-enabled section of said self car at said arrival time based on said arrival time and said position of said front car at said arrival time and waiting for a departure of said self car until a section which does not overlap with said in-fire stop prohibition section is formed in said running-enabled section.

5. A multi-car elevator control device for controlling an operation of each of a plurality of cars in a multi-car elevator system in which said plurality of cars run along a single hoistway, comprising:

a fire floor information acquiring part for acquiring fire floor information;

an in-fire blocking section setting part for setting, as an in-fire blocking section, a section obtained by adding a predetermined safety margin distance in a running direction of a car or both directions thereof to an in-fire stop prohibition section being a floor within a predetermined range including a fire floor; and an in-fire blocking controller for stopping, in a case where a single car is present in said in-fire blocking section, a car positioned in a self car occupying section being a section ranging from a current position to a preceding floor on which a stop is allowed, in which an end floor on a running direction side of the self car occupying section is a floor adjacent to any one of ends of said in-fire blocking section, so as to prevent another car from entering the in-fire blocking section.

6. The multi-car elevator control device according to claim 5, wherein said safety margin distance is determined based on a speed and an acceleration of a car.

7. The multi-car elevator control device according to claim 6, wherein when a car is present in said in-fire blocking section, a speed and a deceleration of a blocking stop target car having said in-fire blocking section adjacently to an end in a running direction of an occupying section are regulated, said device further comprising:

a speed and deceleration candidate presenting part for presenting a candidate for a combination of a speed and a deceleration of said blocking stop target car which reduces said in-fire blocking section;

a passing time calculator for calculating a passing time required for said blocking stop target car to pass through said in-fire blocking section when said candidate is used; and a speed and deceleration selector for selecting said candidate having the shortest passing time as a speed and a deceleration of said blocking stop target car which are new.

8. The multi-car elevator control device according to claim 5, further comprising:

an arrival time predicting part for predicting a time when a departure intended self car arrives at said in-fire blocking section;

a front car position predicting part for predicting a position of a front car at said arrival time; and a car departure deciding part for properly waiting for a departure of said self car in such a manner that said self car arrives at said in-fire blocking section at a timing when said front car passes through said in-fire blocking section.

* * * * *